US008831958B2

(12) United States Patent
Lee et al.

(10) Patent No.: US 8,831,958 B2
(45) Date of Patent: Sep. 9, 2014

(54) METHOD AND AN APPARATUS FOR A BANDWIDTH EXTENSION USING DIFFERENT SCHEMES

(75) Inventors: Hyun Kook Lee, Seoul (KR); Dong Soo Kim, Seoul (KR); Sung Yong Yoon, Seoul (KR); Hee Suk Pang, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 1183 days.

(21) Appl. No.: 12/567,559

(22) Filed: Sep. 25, 2009

(65) Prior Publication Data

US 2010/0114583 A1 May 6, 2010

Related U.S. Application Data

(60) Provisional application No. 61/100,263, filed on Sep. 25, 2008, provisional application No. 61/118,647, filed on Nov. 30, 2008.

(30) Foreign Application Priority Data

Sep. 24, 2009 (KR) ..... 10-2009-0090705

(51) Int. Cl.

| | |
|---|---|
| ***G10L 19/00*** | (2013.01) |
| ***G10L 19/02*** | (2013.01) |
| ***G10L 19/025*** | (2013.01) |
| ***G10L 19/008*** | (2013.01) |

(52) U.S. Cl.

CPC ..... *G10L 19/025* (2013.01); *G10L 19/008* (2013.01); *G10L 19/02* (2013.01)

USPC ..... 704/500; 704/501; 704/216

(58) Field of Classification Search

CPC ..... G10L 19/008; G10L 19/02; G10L 19/025; G10L 19/06

USPC ..... 704/205, 206, 223, 500

See application file for complete search history.

(56) References Cited

U.S. PATENT DOCUMENTS 5,455,888 A * 10/1995 Iyengar et al. ..... 704/203
5,581,652 A * 12/1996 Abe et al. ..... 704/222

(Continued)

FOREIGN PATENT DOCUMENTS

KR 10-0566630 B1 3/2006
KR 10-0707174 7/2006

(Continued)

OTHER PUBLICATIONS

Hsu, "Robust Bandwidth Extension of Narrowband Speech", Department of Electrical & Computer Engineering, McGill University Montreal, Canada, Nov. 2004.*

(Continued)

*Primary Examiner* — Jialong He

(74) *Attorney, Agent, or Firm* — Birch, Stewart, Kolasch & Birch, LLP

(57) ABSTRACT

An apparatus for processing an audio signal and method thereof are disclosed. The present invention includes receiving a spectral data of lower band and type information indicating a particular band extension scheme for a current frame of the audio signal from among a plurality of band extension schemes including a first band extension scheme and a second band extension scheme, by an audio processing apparatus; when the type information indicates the first band extension scheme for the current frame, generating a spectral data of higher band in the current frame using the spectral data of lower band by performing the first band extension scheme; and when the type information indicates the second band extension scheme for the current frame, generating the spectral data of higher band in the current frame using the spectral data of lower band by performing the second band extension scheme, wherein the first band extension scheme is based on a first data area of the spectral data of lower band, and wherein the second band extension scheme is based on a second data area of the spectral data of lower band.

13 Claims, 22 Drawing Sheets

(56) References Cited

U.S. PATENT DOCUMENTS

| | | | | |
|---|---|---|---|---|
| 5,950,153 | A * | 9/1999 | Ohmori et al. | 704/217 |
| 5,978,759 | A * | 11/1999 | Tsushima et al. | 704/223 |
| 6,658,383 | B2 * | 12/2003 | Koishida et al. | 704/229 |
| 6,681,202 | B1 * | 1/2004 | Miet et al. | 704/214 |
| 6,988,066 | B2 * | 1/2006 | Malah | 704/219 |
| 7,359,854 | B2 * | 4/2008 | Nilsson et al. | 704/219 |
| 7,546,237 | B2 * | 6/2009 | Nongpiur et al. | 704/209 |
| 2002/0007280 | A1 * | 1/2002 | McCree | 704/500 |
| 2002/0138268 | A1 * | 9/2002 | Gustafsson | 704/258 |
| 2003/0050786 | A1 * | 3/2003 | Jax et al. | 704/500 |
| 2003/0093278 | A1 * | 5/2003 | Malah | 704/265 |
| 2004/0138876 | A1 * | 7/2004 | Kallio et al. | 704/209 |
| 2004/0243402 | A1 * | 12/2004 | Ozawa | 704/208 |
| 2005/0004793 | A1 * | 1/2005 | Ojala et al. | 704/219 |
| 2005/0004803 | A1 * | 1/2005 | Smeets et al. | 704/500 |
| 2005/0267739 | A1 * | 12/2005 | Kontio et al. | 704/205 |
| 2005/0281416 | A1 | 12/2005 | Aarts et al. | |
| 2006/0149538 | A1 | 7/2006 | Lee et al. | |
| 2007/0088558 | A1 * | 4/2007 | Vos et al. | 704/275 |
| 2008/0208572 | A1 * | 8/2008 | Nongpiur et al. | 704/205 |
| 2008/0215344 | A1 * | 9/2008 | Song et al. | 704/500 |
| 2009/0198498 | A1 * | 8/2009 | Ramabadran et al. | 704/500 |
| 2009/0201983 | A1 * | 8/2009 | Jasiuk et al. | 375/240 |

FOREIGN PATENT DOCUMENTS

| | | | |
|---|---|---|---|
| WO | 98/57436 | A2 | 12/1998 |
| WO | 01/91111 | A1 | 11/2001 |
| WO | 02/052545 | A1 | 7/2002 |
| WO | 03/044777 | A1 | 5/2003 |

OTHER PUBLICATIONS

Ehret et al., "Audio Coding Technology of ExAC," Proceedings of 2004 International Symposium on Intelligent Multimedia, Video and Speech Processing, Oct. 20-22, 2004. Hong Kong, pp. 290-293.

Seng et al., "Low Power Spectral Band Replication Technology for the MPEG-4 Audio Standard," Joint Conference of International Conference on Information, Communication and Signal Processing and the Fourth Pacific Rim Conference on Multimedia, Dec. 15-16, 2003, Singapore, pp. 1408-1412.

Shin et al., "Designing a unified speech/audio codec by adopting a single channel harmonic source separation module," IEEE 08, ICASSP, Mar. 31-Apr. 4, 2008, Korea, pp. 185-188.

Stott, "DRM-key technical features," EBU Technical Review, Mar. 2001, pp. 1-24.

* cited by examiner (A)

(B)

METHOD AND AN APPARATUS FOR A BANDWIDTH EXTENSION USING DIFFERENT SCHEMES

CROSS-REFERENCE TO RELATED APPLICATION

This application claims the benefit of U.S. Provisional Application No. 61/100,263 filed on Sep. 25, 2008, U.S. Provisional Application No. 61/118,647, filed on Nov. 30, 2008, and KR Patent Application No. 10-2009-0090705, filed on Sep. 24, 2009, which are hereby incorporated by reference.

BACKGROUND OF THE INVENTION

1. Field of the Invention

The present invention relates to an apparatus for processing an audio signal and method thereof. Although the present invention is suitable for a wide scope of applications, it is particularly suitable for encoding or decoding audio signals.

2. Discussion of the Related Art

Generally, an audio signal has correlation between a low frequency band signal and a high frequency band signal within one frame. In consideration of the principle of the correlation, it is able to compress an audio signal by a band extension technology that encodes high frequency band spectral data using low frequency band spectral data.

However, in the related art, in case that low correlation exists between a low frequency band signal and a high frequency band signal, if an audio signal is compressed using a band extension scheme, a sound quality of the audio signal is degraded.

Specifically, in case of sibilant or the like, since the correlation is not high, the band extension scheme for the audio signal is not suitable for the sibilant or the like.

Meanwhile, there are band extension schemes of various types. A type of a band extension scheme applied to an audio signal may differ according to a time. In this case, a sound quality may be instantly degraded in an interval where a different type varies.

SUMMARY OF THE INVENTION

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, by which a band extension scheme can be selectively applied according to a characteristic of an audio signal.

Another object of the present invention is to provide an apparatus for processing an audio signal and method thereof, by which a suitable scheme can be adaptively applied according to a characteristic of an audio signal per frame instead of using a band extension scheme.

A further object of the present invention is to provide an apparatus for processing an audio signal and method thereof, by which a quality of sound can be maintained by avoiding an application of a band extension scheme if an analyzed audio signal characteristic is close to sibilant.

Another object of the present invention is to provide an apparatus for processing an audio signal and method thereof, by which band extension schemes of various types are applied per time according to a characteristic of an audio signal.

Another object of the present invention is to provide an apparatus for processing an audio signal and method thereof, by which artifact can be reduced in a band extension scheme type varying interval in case of applying band extension schemes of various types.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method for processing an audio signal, comprising: receiving a spectral data of lower band and type information indicating a particular band extension scheme for a current frame of the audio signal from among a plurality of band extension schemes including a first band extension scheme and a second band extension scheme, by an audio processing apparatus; when the type information indicates the first band extension scheme for the current frame, generating a spectral data of higher band in the current frame using the spectral data of lower band by performing the first band extension scheme; and when the type information indicates the second band extension scheme for the current frame, generating the spectral data of higher band in the current frame using the spectral data of lower band by performing the second band extension scheme, wherein the first band extension scheme is based on a first data area of the spectral data of lower band, and wherein the second band extension scheme is based on a second data area of the spectral data of lower band.

According to the present invention, the first data area is a portion of the spectral data of lower band, and, wherein the second data area is a plurality of portions including the portion of the spectral data of lower band.

According to the present invention, the first data area is a portion of the spectral data of lower band, and, wherein the second data area is all of the spectral data of lower band.

According to the present invention, the second data area is greater than the first data area.

According to the present invention, the higher band comprises at least one band equal to or higher than a boundary frequency and wherein the lower band comprises at least one band equal to or lower than the boundary frequency.

According to the present invention, the first band extension scheme is performed using at least one operation of bandpass filtering, time stretching processing and decimation processing.

According to the present invention, the method further comprises receiving band extension information including envelop information, the first band extension scheme or the second band extension scheme is performed using the band extension information.

According to the present invention, the method further comprises decoding the spectral data of lower band according to either an audio coding scheme on frequency domain or a speech coding scheme on time domain, wherein the spectral data of higher band is generated using the decoded spectral data of lower band.

To further achieve these and other advantages and in accordance with the purpose of the present invention, an apparatus for processing an audio signal, comprising: a de-multiplexer receiving a spectral data of lower band and type information indicating a particular band extension scheme for a current frame of the audio signal from among a plurality of band extension schemes including a first band extension scheme and a second band extension scheme; a first band extension decoding unit, when the type information indicates the first band extension scheme for the current frame, generating a spectral data of higher band in the current frame using the spectral data of lower band by performing the first band extension scheme; and a second band extension decoding unit, when the type information indicates the second band extension scheme for the current frame, generating the spectral data of higher band in the current frame using the spectral data of lower band by performing the second band extension scheme, wherein the first band extension scheme is based on a first data area of the spectral data of lower band, and wherein the second band extension scheme is based on a second data area of the spectral data of lower band.

According to the present invention, the de-multiplexer further receives band extension information including envelop information, and the first band extension scheme or the second band extension scheme is performed using the band extension information.

According to the present invention, the apparatus further comprises an audio signal decoder decoding the spectral data of lower band according to an audio coding scheme on frequency domain; and, a speech signal decoder decoding the spectral data of lower band according to a speech coding scheme on time domain, wherein the spectral data of higher band is generated using the spectral data of lower band decoded by either the audio signal decoder or the speech signal decoder.

To further achieve these and other advantages and in accordance with the purpose of the present invention, a method for processing an audio signal, comprising: detecting a transient proportion for a current frame of the audio signal by an audio processing apparatus; determining a particular band extension scheme for the current frame among a plurality of band extension schemes including a first band extension scheme and a second band extension scheme based on the transient proportion; generating type information indicating the particular band extension scheme; when the particular band extension scheme is the first band extension scheme for the current frame, generating a spectral data of higher band in the current frame using the spectral data of lower band by performing the first band extension scheme; when the particular band extension scheme is the second band extension scheme for the current frame, generating the spectral data of higher band in the current frame using the spectral data of lower band by performing the second band extension scheme; and transferring the type information and the spectral data of lower band, wherein the first band extension scheme is based on a first data area of the spectral data of lower band, and wherein the second band extension scheme is based on a second data area of the spectral data of lower band.

To further achieve these and other advantages and in accordance with the purpose of the present invention, an apparatus for processing an audio signal, comprising: a transient detecting part detecting a transient proportion for a current frame of the audio signal; a type information generating part determining a particular band extension scheme for the current frame among a plurality of band extension schemes including a first band extension scheme and a second band extension scheme based on the transient proportion, the type information generating part generating type information indicating the particular band extension scheme; a first band extension encoding unit, when the particular band extension scheme is the first band extension scheme for the current frame, generating a spectral data of higher band in the current frame using the spectral data of lower band by performing the first band extension scheme; a second band extension encoding unit, when the particular band extension scheme is the second band extension scheme for the current frame, generating the spectral data of higher band in the current frame using the spectral data of lower band by performing the second band extension scheme; and a multiplexer transferring the type information and the spectral data of lower band, wherein the first band extension scheme is based on a first data area of the spectral data of lower band, and wherein the second band extension scheme is based on a second data area of the spectral data of lower band.

To further achieve these and other advantages and in accordance with the purpose of the present invention, a computer-readable medium comprising instructions stored thereon, which, when executed by a processor, causes the processor to perform operations, the instructions comprising: receiving a spectral data of lower band and type information indicating a particular band extension scheme for a current frame of an audio signal from among a plurality of band extension schemes including a first band extension scheme and a second band extension scheme, by an audio processing apparatus; when the type information indicates the first band extension scheme for the current frame, generating a spectral data of higher band in the current flame using the spectral data of lower band by performing the first band extension scheme; and when the type information indicates the second band extension scheme for the current frame, generating the spectral data of higher band in the current frame using the spectral data of lower band by performing the second band extension scheme, wherein the first band extension scheme is based on a first data area of the spectral data of lower band, and wherein the second band extension scheme is based on a second data area of the spectral data of lower band.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

The following terminologies in the present invention can be construed based on the following criteria and other terminologies failing to be explained can be construed according to the following purposes. First of all, it is understood that the concept 'coding' in the present invention can be construed as either encoding or decoding in case. Secondly, 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and designates all kinds of signals that can be auditorily identified. In a narrow sense, the audio signal means a signal having none or small quantity of speech characteristics. Audio signal of the present invention should be construed in a broad sense. And, the audio signal of the present invention can be understood as a narrow-sense audio signal in case of being used by being discriminated from a speech signal.

Figure 1:
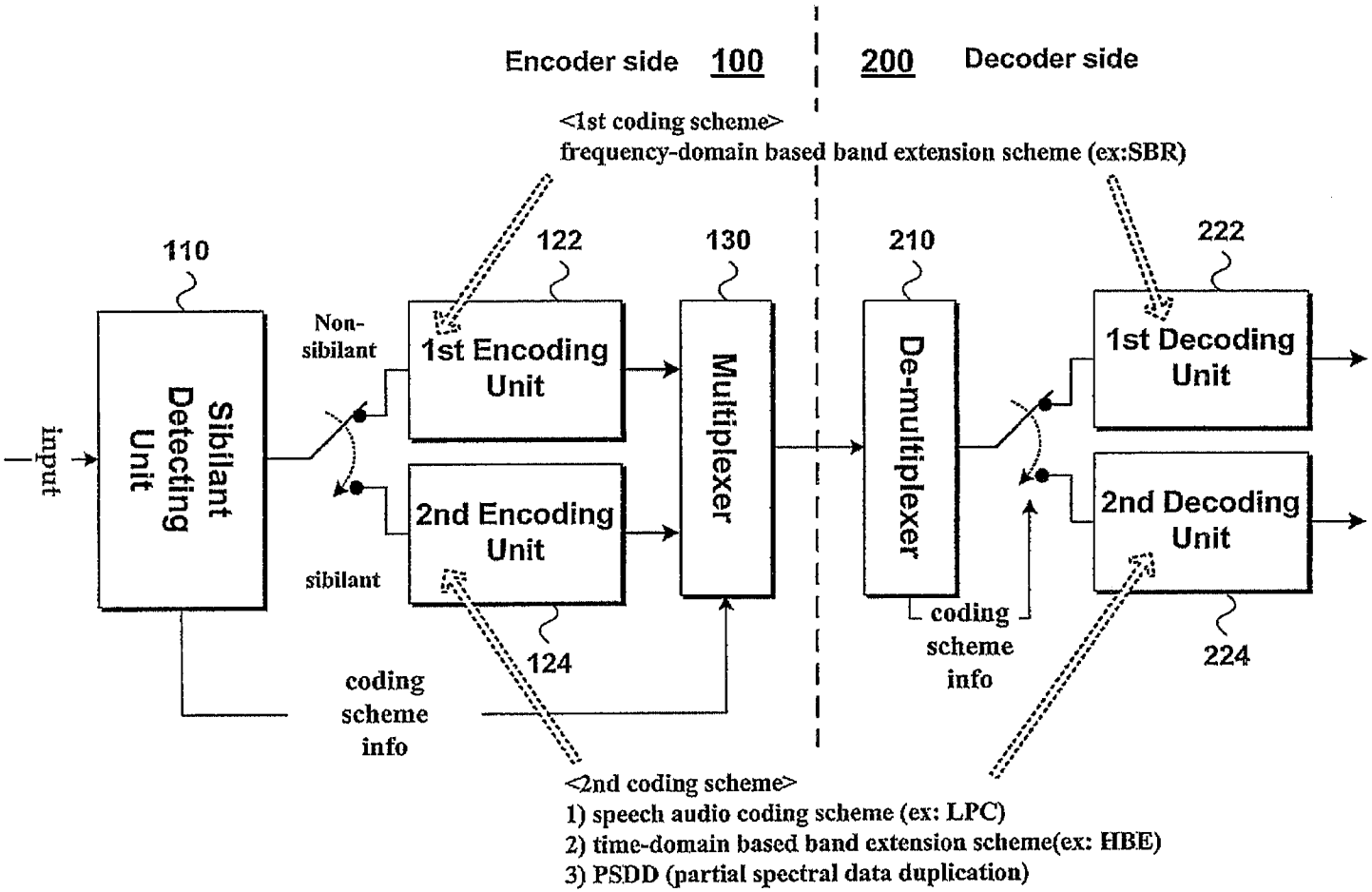
FIG. 1 is a block diagram of an audio signal processing apparatus according to an embodiment of the present invention.

FIG. 1 is a block diagram of an audio signal processing apparatus according to an embodiment of the present invention.

Referring to FIG. 1, an encoder side 100 of an audio signal processing apparatus can include a sibilant detecting unit 110, a first encoding unit 122, a second encoding unit 124 and a multiplexing unit 130. A decoder side 200 of the audio signal processing apparatus can include a demultiplexer 210, a first decoding unit 222 and a second decoding unit 224.

The encoder side 100 of the audio signal processing apparatus determines whether to apply a band extension scheme according to a characteristic of an audio signal and then generates coding scheme information according to the determination. Subsequently, the decoder side 200 selects whether to apply the band extension scheme per frame according to the coding scheme information.

The sibilant detecting unit 110 detects a sibilant proportion for a current frame of an audio signal. Based on the detected sibilant proportion, the sibilant detecting unit 110 generates coding scheme information indicating whether the band extension scheme will be applied to the current frame. In this case, the sibilant proportion means an extent for a presence or non-presence of sibilant in the current frame. The sibilant is a consonant such as a hissing sound generated using friction of air sucked into a narrow gap between teeth. For instance, such a sibilant includes 'ㅅ', 'ㅆ' and the like in Korean. For instance, such a sibilant includes such a consonant 's' in English. Meanwhile, affricate is a consonant sound that begins as a plosive and becomes a fricative such as 'ㅈ', 'ㅊ', 'ㅉ', etc. in Korean. In this disclosure, 'sibilant' is not limited to a specific sound but indicates a sound of which peak band having maximum energy belonging to a frequency band higher than that of other sounds. Detailed configuration of the sibilant detecting unit 110 will be explained later with reference to FIG. 2.

As a result of detecting the sibilant proportion, if it is determined that a prescribed frame has a less sibilant proportion, an audio signal is encoded by the first encoding unit 122. If it is determined that a prescribed frame has a more sibilant proportion, an audio signal is encoded by the second encoding unit 124.

The first encoding unit 122 is an element that encodes an audio signal in a frequency domain based band extension scheme. In this case, by the frequency domain based band extension scheme, spectral data corresponding to a higher band in wide band spectral data is encoded using all or a portion of a narrow band. This scheme is able to reduce the bit number in consideration of the principle of correlation between a high frequency band and a low frequency band. In this case, the band extension scheme is based on a frequency domain and the spectral data is the data frequency-transformed by a QMF (quadrature mirror filter) filterbank or the like. A decoder reconstructs spectral data of a higher band from narrow band spectral data using band extension information. In this case,the higher band is a band having a frequency equal to or higher than a boundary frequency. The narrow band (or lower band) is a band having a frequency equal to or lower than a boundary frequency and is constructed with consecutive bands. This frequency domain based band extension scheme may conform with the SBR (spectral band replication) or eSBR (enhanced spectral band replication) standard, by which the present invention is non-limited.

Meanwhile, this frequency domain based band extension scheme is based on the correlation between a high frequency band and a low frequency band. And, this correlation may be strong or weak according to a characteristic of an audio signal. Specifically, in case of the above-mentioned sibilant, since the correlation is weak, if a band extension scheme is applied to a frame corresponding to the sibilant, a sound quality may be degraded. The application relation between energy characteristic of the sibilant and the frequency domain based band extension scheme will be explained in detail with reference to FIG. 3 and FIG. 4 later. The first encoding unit 122 may have the concept including an audio signal encoder explained in the following description with reference to FIG. 8, by which the present invention is non-limited.

The second encoding unit 124 is a unit that encodes an audio signal without using the frequency domain based band extension scheme. In this case, instead of not using band extension schemes of all types, the specific frequency domain based band extension scheme applied to the first encoding unit 122 is not used. First of all, the second encoding unit 124 corresponds to a speech signal encoder that applies a linear predictive coding (LPC) scheme. Secondly, the second encoding unit 124 further includes a module according to a time domain based band extension scheme as well as a speech encoder. Thirdly, the second encoding unit 124 is able to further include a module according to a PSDD (partial spectral data duplication) scheme newly proposed by this application. The corresponding details will be explained with reference to FIGS. 5 to 8 later. Meanwhile, the second time domain based band extension scheme may follow the HBE (high band extension) scheme applied to the AMR-WB (adaptive multi rate-wideband) standard, by which the present invention is non-limited.

The multiplexer 130 generates at least one bitstream by multiplexing the audio signal encoded by the first encoding unit 122 and the non-band extension encoding unit 124 with the coding scheme information generated by the sibilant detecting unit 110.

The demultiplexer 210 of the decoder side extracts the coding scheme information from the bitstream and then delivers an audio signal of a current frame to the first decoding unit 222 or the second decoding unit 224 based on the coding scheme information. The first decoding unit 222 decodes the audio signal by the above-mentioned band extension scheme and the second decoding unit 224 decodes the audio signal by the above-mentioned LPC scheme (or HBE/PSDD scheme).

Figure 2:
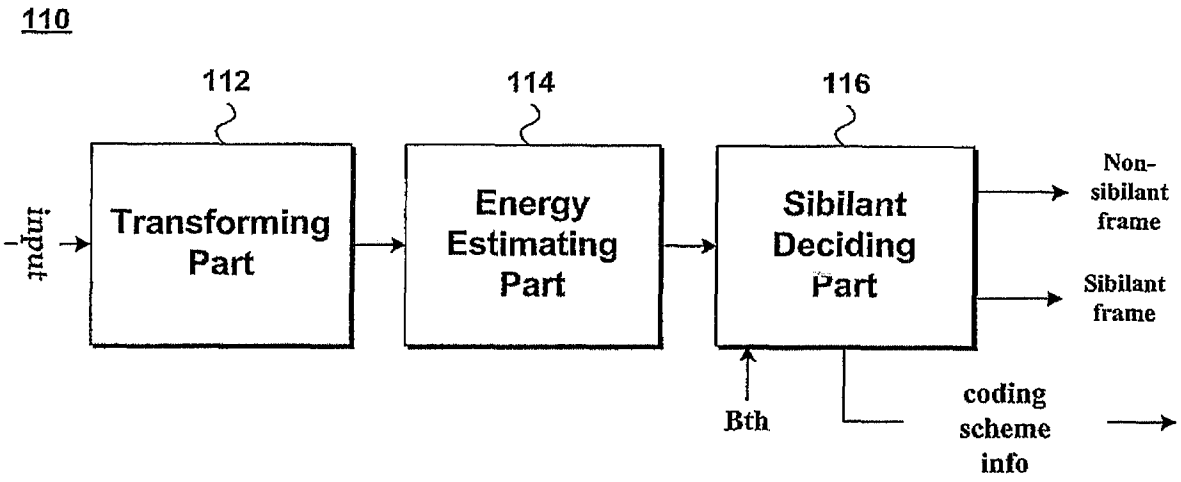
FIG. 2 is a detailed block diagram of a sibilant detecting unit shown in FIG. 1.
Figure 3:
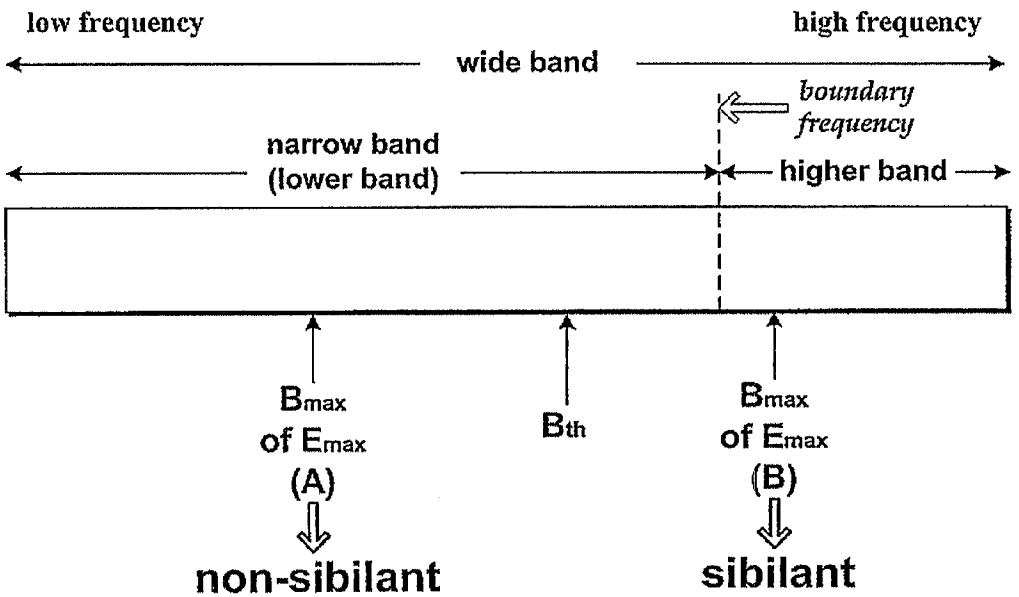
FIG. 3 is a diagram for explaining a principle of sibilant detecting.
Figure 4:
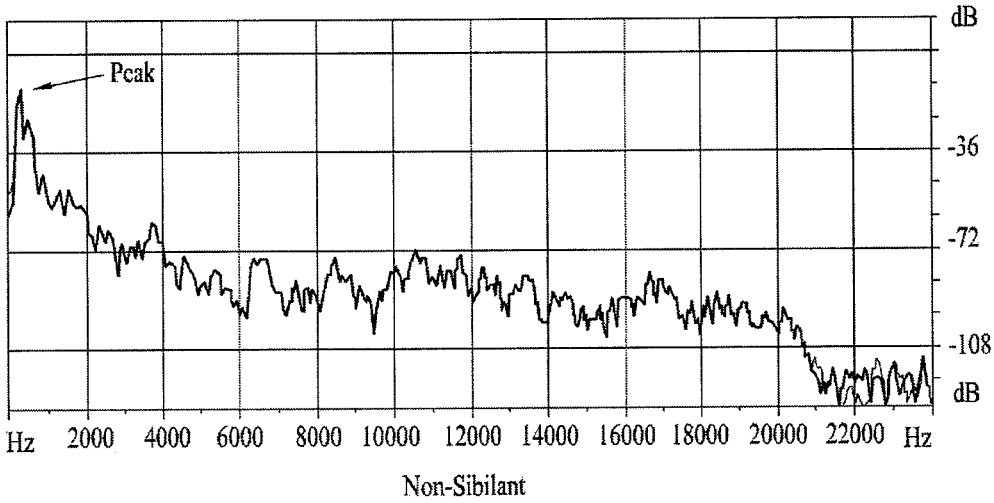
FIG. 4 is a diagram for an example of an energy spectrum for non-sibilant and an example of an energy spectrum for sibilant.
Figure 4:
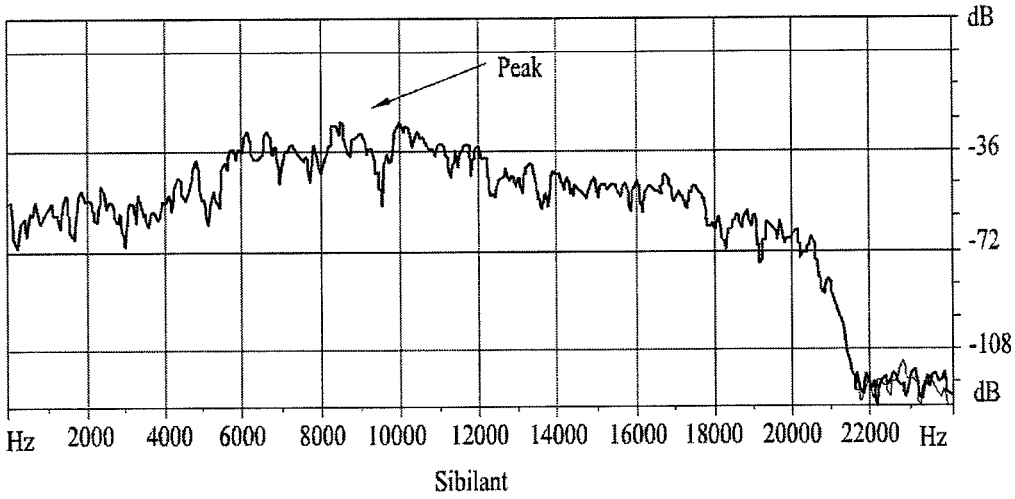

FIG. 2 is a detailed block diagram of the sibilant detecting unit shown in FIG. 1, FIG. 3 is a diagram for explaining a principle of sibilant detecting, and FIG. 4 is a diagram for an example of an energy spectrum for non-sibilant and an example of an energy spectrum for sibilant.

Referring to FIG. 2, the sibilant detecting unit 110 includes a transforming part 112, an energy estimating part 114 and a sibilant decoding part 116.

The transforming part 112 transforms a time domain audio signal into a frequency domain signal by performing frequency transform on an audio signal. In this case, this frequency transform can use one of FFT (fast Fourier transform), MDCT (modified discrete cosine transform) and the like, by which the present invention is non-limited.

The energy estimating part 114 calculates energy per band for a current frame by binding a frequency domain audio signal per several bands. The energy estimating part 114 then decides what is a peak band $B_{max}$, having maximum energy in a whole band. The sibilant deciding part 116 detects a sibilant proportion of the current frame by deciding whether the band $B_{max}$, having the maximum energy is higher or lower than a threshold band $B_{th}$. This is based on the characteristic that a vocal sound has maximum energy in a low frequency, whereas a sibilant has maximum energy in a high frequency. In this case, the threshold band $B_{th}$ may be a preset value set to a default value or a value calculated according to a characteristic of an inputted audio signal.

Referring to FIG. 3, it can be observed that a wide band including a narrow band (or lower band) and a higher band exits. A peak band $B_{max}$, having maximum energy $E_{max}$ may be higher or lower than a threshold band $B_{th}$. Meanwhile, referring to FIG. 4, it can be observed that an energy peak of a signal of non-sibilant exits on a low frequency band. And, it can be also observed that an energy peak of a sibilant signal exists on a relatively high frequency band. Referring now to FIG. 3, in case of (A), since an energy peak exists in a relative low frequency, it is decided as non-sibilant. In case of (B), since an energy pea exists in a relative high frequency, it can be decided as sibilant.

Meanwhile, the formerly mentioned frequency domain based band extension scheme encodes a higher band higher than a boundary frequency using a narrow band lower than the boundary frequency. This scheme is based on the correlation between spectral data of narrow band and spectral data of higher band. Yet, in case of a signal of which energy peak exists in a high frequency, the correlation is relatively reduced. Thus, if the frequency domain based band extension scheme for predicting spectral data of higher band using spectral data of the narrow band is applied, it may degrade a quality of sound. Therefore, to a current frame decided as sibilant, it is preferable that another scheme is applied rather than the frequency domain based band extension scheme.

Referring now to FIG. 3, if a peak band $B_{max}$ of an energy peak is lower than a threshold band $B_{th}$, the sibilant deciding part 116 decides a current frame as non-sibilant and then enables an audio signal to be encoded according to a frequency domain based band extension scheme by the first encoding unit. Otherwise, the sibilant deciding part 116 decides a current frame as sibilant and then enables an audio signal to be encoded according to an alternative scheme by the second encoding unit.

Figure 5:
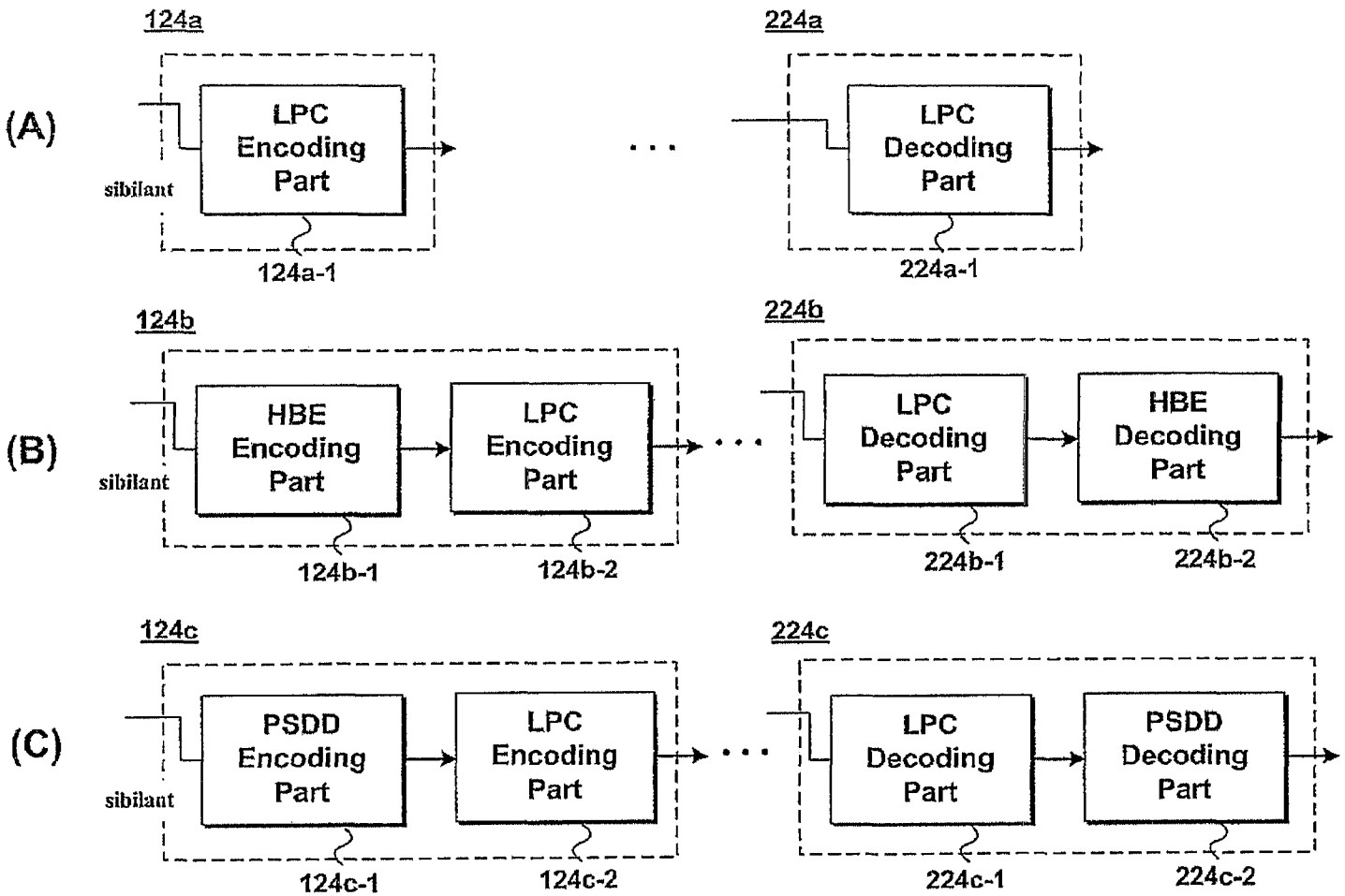
FIG. 5 is a diagram for examples of detailed configurations of a second encoding unit and a second decoding unit shown in FIG. 1.

FIG. 5 is a diagram for examples of detailed configurations of the second encoding decoding units shown in FIG. 1.

Referring to (A) of FIG. 5, a second encoding unit **124*a* according to a first embodiment includes an LPC encoding part 124*a*-1. And, a second decoding unit 224*a* according to the first embodiment includes an LPC decoding part 224*a*-1. The LPC encoding part and the LPC decoding part are the elements for encoding or decoding an audio signal on a whole band by a linear prediction coding (LPC) scheme. The LPC (linear prediction coding) is to predict a current sample value in a manner of multiplying a predetermined number of previous sample values by a coefficient and then adding up the results. The LPC corresponds to a representative example of short term prediction (STP) for processing a speech signal on the basis of a time domain. If the LPC encoding part 124***a*-1 generates an LPC coefficient (not shown in the drawing) encoded by the LPC scheme, the LPC decoding part 224*a*-1 reconstructs an audio signal using the LPC coefficient.

Meanwhile, a second encoding unit 124*b* according to a second embodiment includes an HBE encoding part 124*b*-1 and an LPC encoding part 124*b*-2. And, a second decoding unit 224*b* according to the second embodiment includes an LPC decoding part 224*b*-1 and an HBE decoding part 224*b*-2. The HBE encoding part 124*b*-1 and the HBE decoding part 224*b*-2 are elements for encoding/decoding an audio signal according to HBE scheme. The HBE (high band extension) scheme is a sort of a time domain based band extension scheme. An encoder generates HBE information, i.e., spectral envelope modeling information and frame energy information, for a high frequency signal and also generates an excitation signal for a low frequency signal. In this case, the spectral envelope modeling information may correspond to information indicating that an LP coefficient generated through time domain based LP (linear prediction) analysis is transformed into ISP (immittance spectral pair). The frame energy information may correspond to information determined by comparing original energy to synthesized energy per 64 subframes. A decoder generates a high frequency signal by shaping an excitation signal of a low frequency signal using the spectral envelope modeling information and the frame energy information. This HBE scheme differs from the above-mentioned frequency domain based band extension scheme in being based on a time domain. In aspect of time axis waveform, the sibilant is a very complicated and random noise-like signal. If the sibilant is band-extended based on a frequency domain, it may become very inaccurate. Yet, since the HBE is based on a time domain, it is able to appropriately process the sibilant. Meanwhile, if the HBE scheme further includes post-processing for reducing buzzness of a high frequency excitation signal, it is able to further enhance performance on a sibilant frame.

Meanwhile, the LPC encoding part 124*b*-2 and the LPC decoding part 224*b*-1 perform the same functions of the elements 124*a*-1 and 224*a*-1 having the same names of the first embodiments. According to the first embodiment, linear predictive encoding/decoding is performed on a whole band of a current frame. Yet, according to the second embodiment, linear predictive encoding is performed not on a whole band but on a narrow band (or lower band) after execution of HBE. After the linear predictive decoding has been performed on the narrow band, HBE decoding is performed.

A second encoding unit 124*c* according to a third embodiment includes a PSDD encoding part 124*c*-1 and an LPC encoding part 124*c*-2. And, a second decoding unit 224*c* according to the third embodiment includes an LPC decoding part 224*c*-1 and a PSDD decoding part 224*c*-2. The frequency domain based band extension scheme performed by the first encoding unit 122 shown in FIG. 1 uses all or a portion of a narrow band constructed with a low frequency band. On the contrary, PSDD (partial spectral data duplication) uses a copy band discretely distributed on a low frequency band and a high frequency band and then encodes a target band adjacent to the copy band. Corresponding details shall be explained with reference to FIGS. 6 to 8 later.

Meanwhile, the LPC encoding and decoding parts described with reference to (A) to (C) of FIG. 5 can belong to speech signal encoder and decoder 440 and 630, which will be described with reference to FIGS. 9 to 12, respectively.

Figure 6:
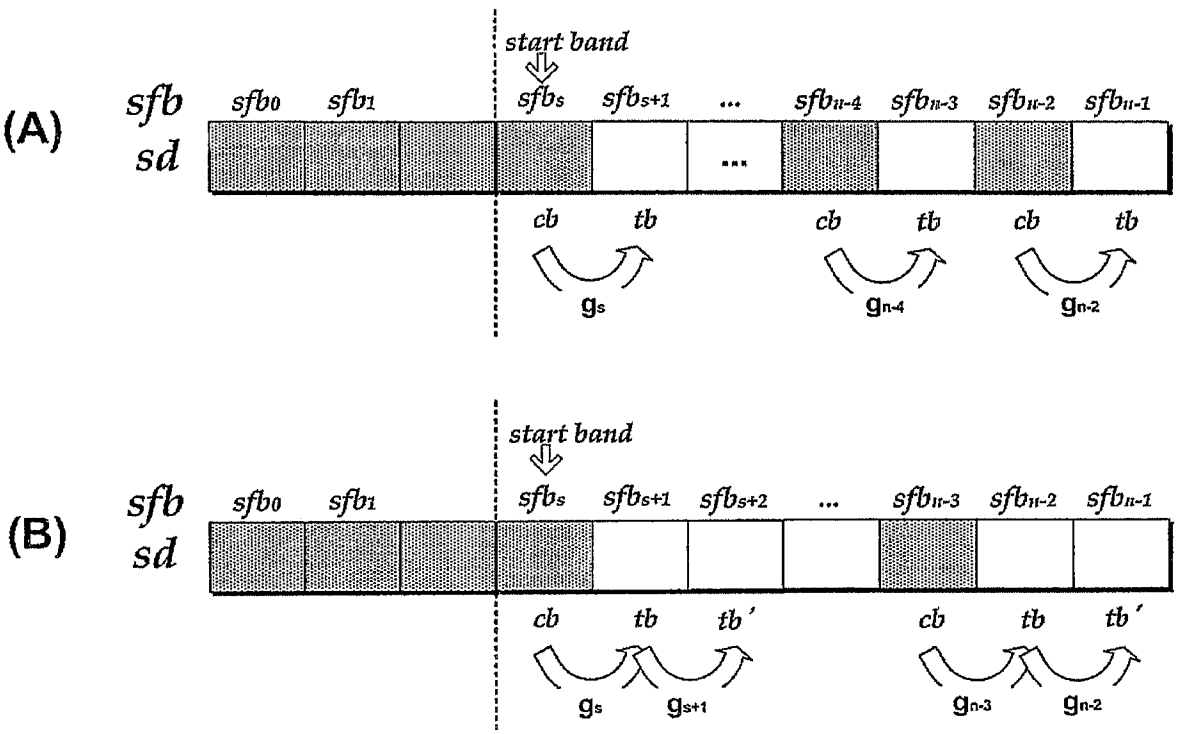
FIG. 6 is a diagram for explaining first and second embodiments of a PSDD (partial spectral data duplication) scheme as an example of a non-band extension encoding/decoding scheme.

FIG. 6 is a diagram for explaining first and second embodiments of a PSDD (partial spectral data duplication) scheme as an example of a non-band extension encoding/decoding scheme.

Referring to (A) of FIG. 6, there exist total n scale factor bands $sfb_0$ to $sfb_{n-1}$ ranging from a low frequency to a high frequency, i.e., $0^{th}$ to $(n-1)^{th}$. And, spectral data corresponding to the scale factor bands $sfb_0$ to $sfb_{n-1}$ exist, respectively. Spectral data $sd_i$ belonging to a specific band may mean a set of a plurality of spectral data $sd_{i_0}$ to $sd_{i_m-1}$. And, it is able to generate the number m, of spectral data to correspond to a spectral data unit, a band unit or a higher unit.

In this case, a band for transferring data to a decoder includes a low frequency band ($sfb_0, \ldots, sfb_{s-1}$) and a copy band (cb) ($sfb_s$, $sfb_{n-4}$, $sfb_{n-2}$) in a whole band ($sfb_0, \ldots, sfb_{n-1}$). The copy band is a band starting from a start band (sb) or a start frequency and is used for prediction of a target band (tb) ($sfb_{s+1}$, $sfb_{n-3}$, $sfb_{n-1}$). The target band is a band predicted using the copy band and does not transfer spectral data to a decoder.

Referring to (A) of FIG. 6, since the copy band exists on a high frequency band instead of being concentrated on a low frequency band. Since the copy band is adjacent to the target band, it is able to maintain correlation with the target band. Meanwhile, it is able to generate gain information (g) that is a difference between spectral data of a copy band and spectral data of a target band. Even if a target bad is predicted using a copy band, it is able to minimize degradation of a sound quality without increasing a bit rate less than that of a band extension scheme.

In (A) of FIG. 6, shown is an example that a bandwidth of a copy band is equal to a bandwidth o a target band. In (B) of FIG. 6, shown is an example that a bandwidth of a copy band is different from a bandwidth of a target band.

Referring to (B) of FIG. 6, a bandwidth of a target band is at least two times (tb, tb') greater than a bandwidth of a copy band. In this case, it is able to apply different gains ($g_s$, $g_{s+1}$) to a left band tb and a right band tb' among the consecutive bands constructing the target band, respectively.

Figure 7:
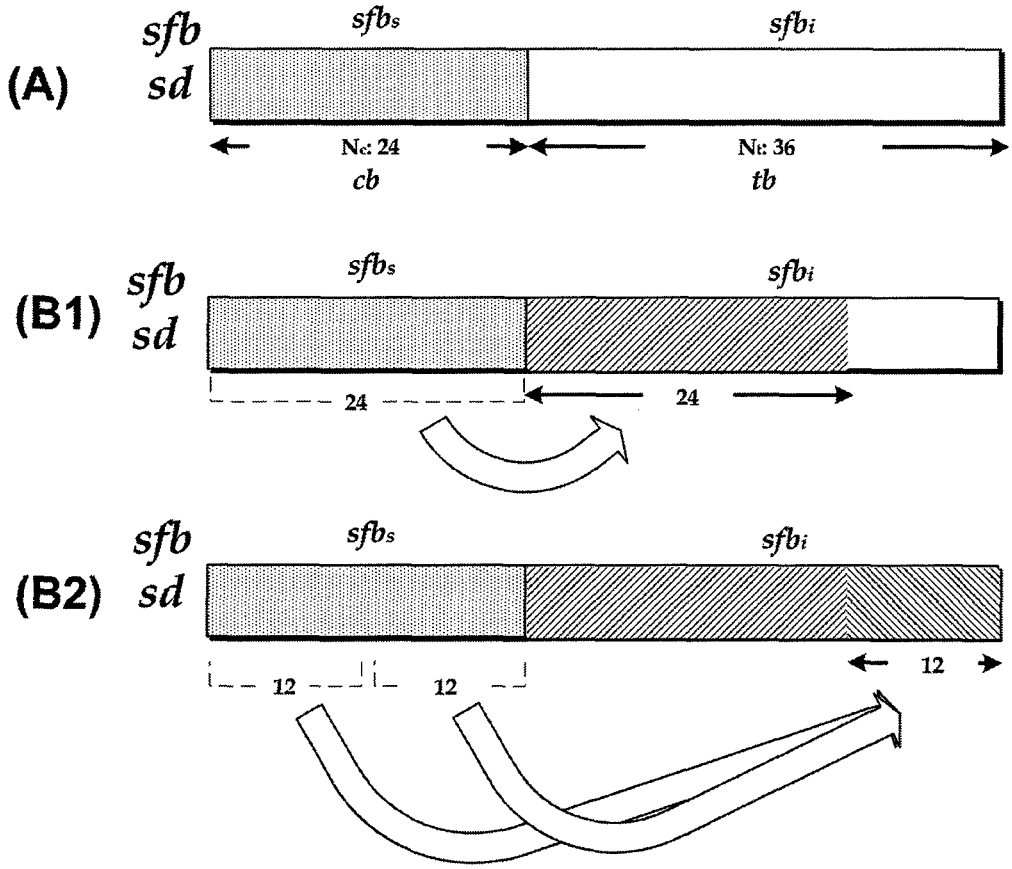
FIG. 7 and FIG. 8 are diagrams for explaining cases that a length of a frame differs in a PSDD scheme.
Figure 8:
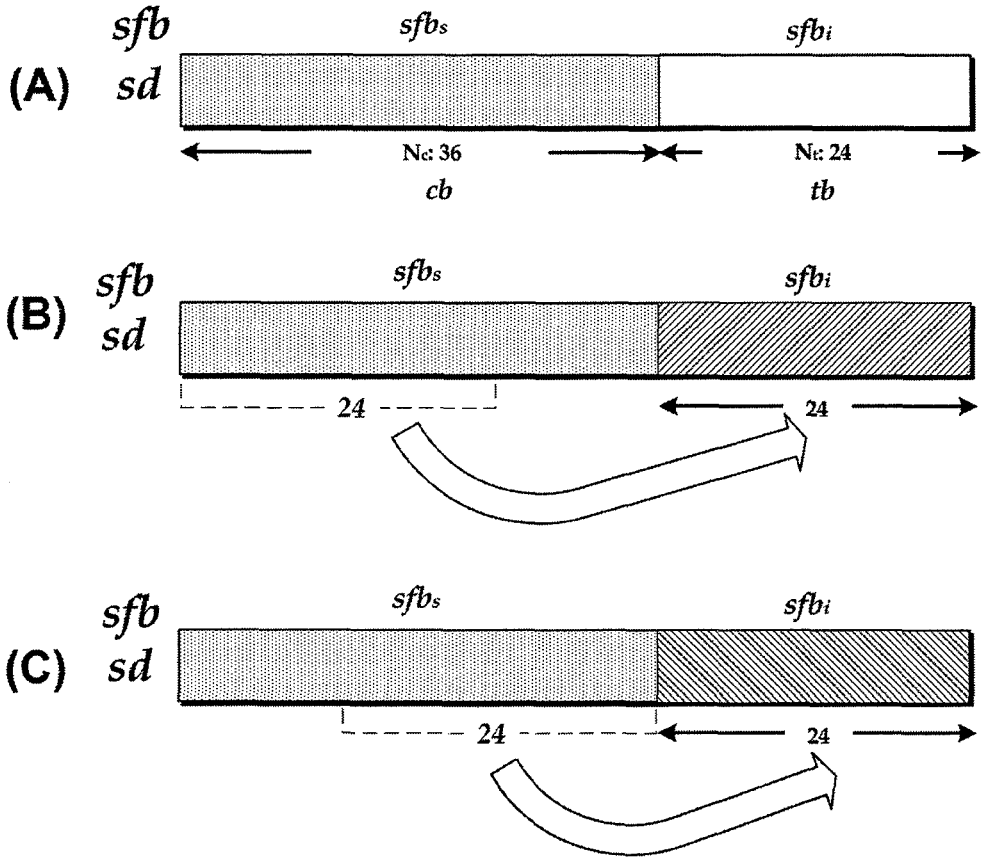

FIG. 7 and FIG. 8 are diagrams for explaining cases that a length of a frame differs in a PSDD scheme. FIG. 7 shows a case that the number $N_t$ of spectral data of a target band is greater than the number $N_c$ of spectral data of a copy band. FIG. 8 shows a case that the number $N_t$ of spectral data of a target band is smaller than the number $N_c$ of spectral data of a copy band.

Referring to (A) of FIG. 7, it can be observed that the number $N_t$ of spectral data of a target band $sfb_t$ is 36 and the number $N_c$ of spectral data of a copy band $sfb_s$ is 24. As the number of data gets incremented, a horizontal length of a band is represented longer. Since the data number of the target band is greater, it is able to use data of the copy band at least twice. For instance, referring to (B1) of FIG. 7, 24 data of a copy band is preferentially padded into a low frequency of a target band. Referring to (B2) of FIG. 7, it is able to front or rear 12 data of the copy band can be padded into the rest part of the target band. Of course, it is able to apply the transferred gain information as well.

Referring to (A) of FIG. 8, it can be observed that the number $N_t$ of spectral data of a target band $sfb_t$ is 24 and the number $N_c$ of spectral data of a copy band $sfb_s$ is 36. Since the data number of the target band is smaller, it is just able to partially use data of the copy band. For instance, referring to (B) of FIG. 8, it is able to generate spectral data of the target band $sfb_t$ using 24 spectral data in a front part of the copy band $sfb_s$ only. Referring to (C) of FIG. 8, it is able to generate spectral data of the target band $sfb_i$ using 24 spectral data in a rear part of the copy band $sfb_s$ only.

Figure 9:
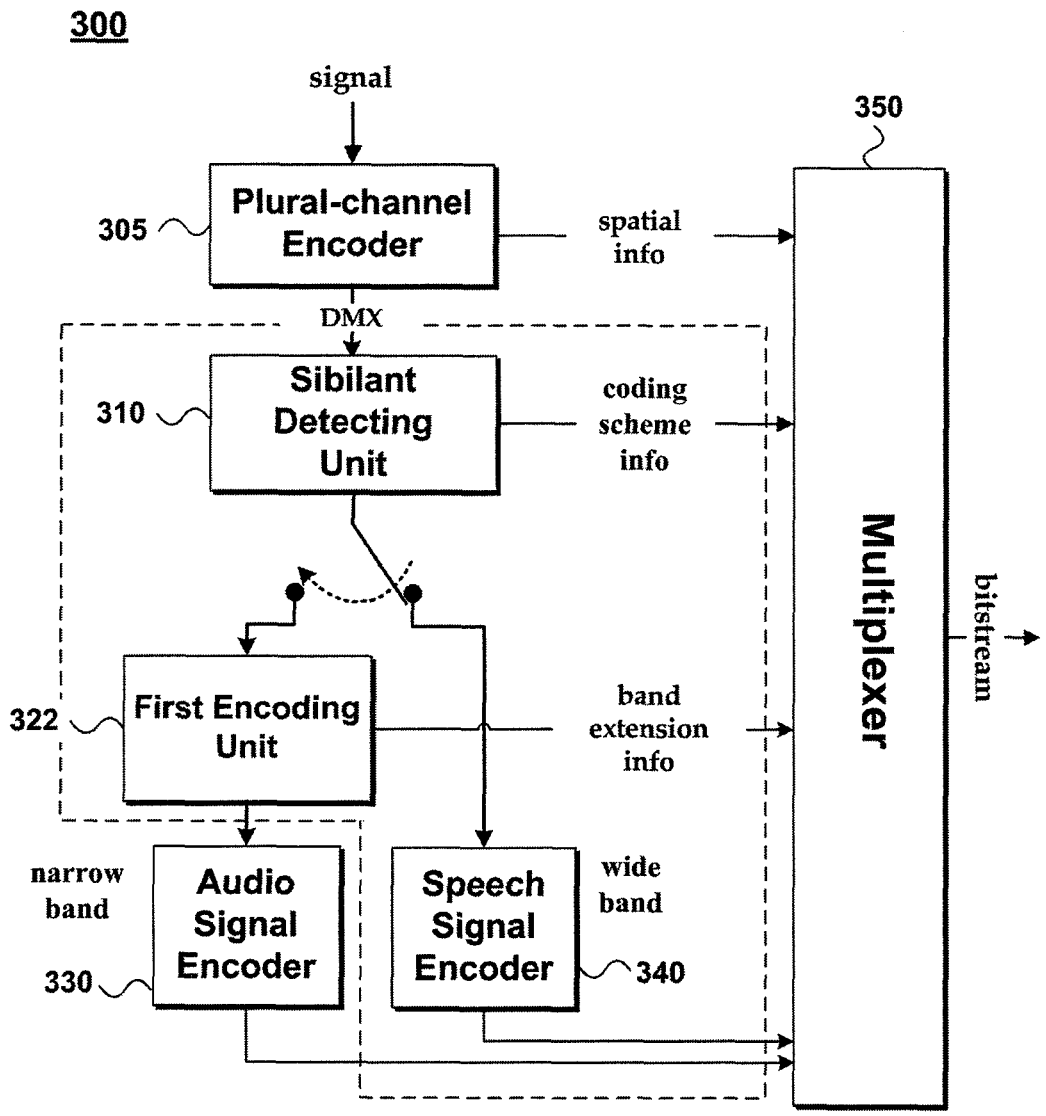
FIG. 9 is a block diagram for a first example of an audio signal encoding device to which an audio signal processing apparatus according to an embodiment of the present invention is applied.
Figure 10:
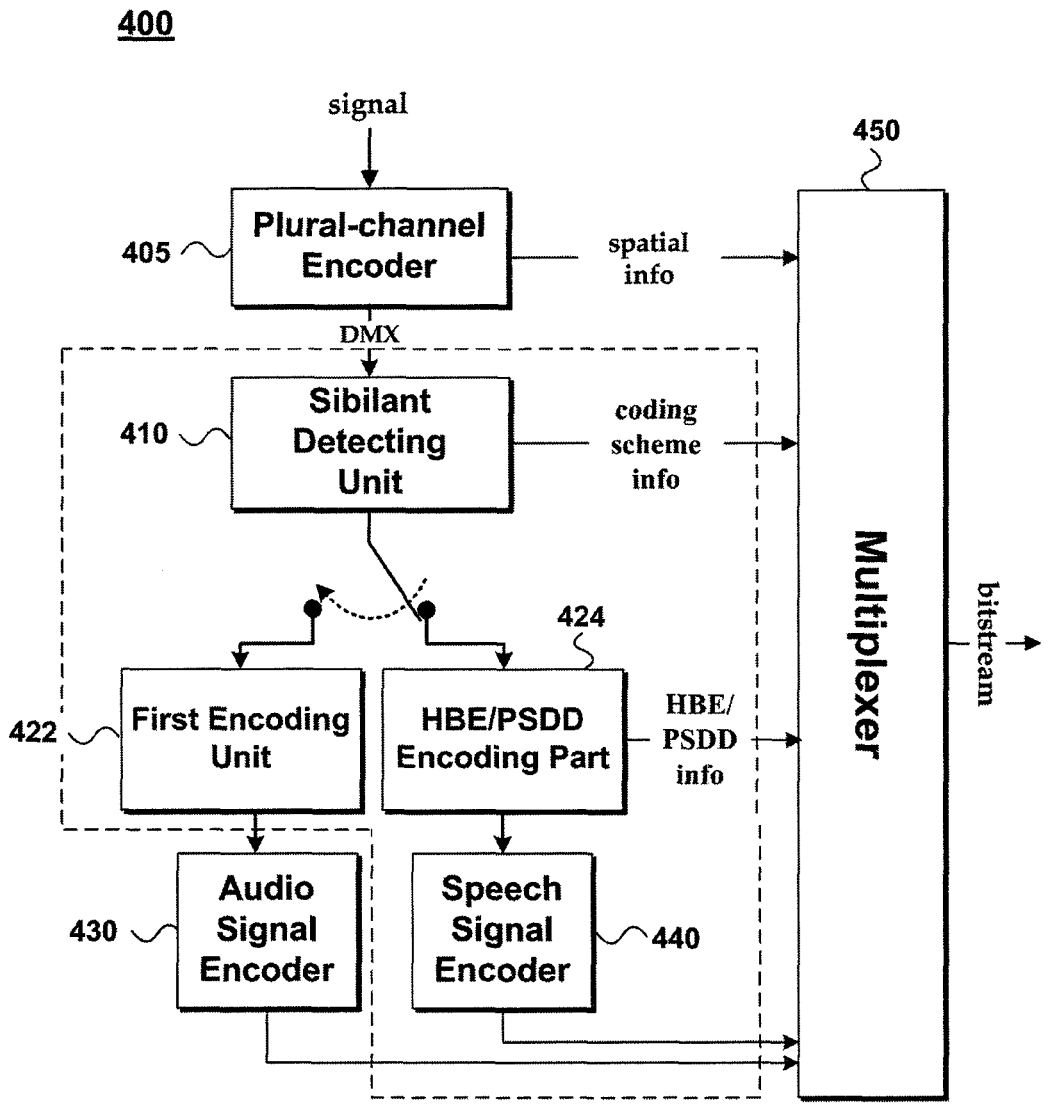
FIG. 10 is a block diagram for a second example of an audio signal encoding device to which an audio signal processing apparatus according to an embodiment of the present invention is applied.

FIG. 9 shows a first example of an audio signal encoding device to which an audio signal processing apparatus according to an embodiment of the present invention is applied. And, FIG. 10 shows a second example of the audio signal encoding device. The first example is an encoding device to which the first embodiment 124*a* of the second encoding unit described with reference to (A) of FIG. 5 is applied. The second example is an encoding device to which the second/third embodiment 124*b*/124*c* of the second encoding unit described with reference to (B)/(C) of FIG. 5 is applied.

Referring to FIG. 9, an audio signal encoding device 300 includes a plural-channel encoder 305, a sibilant detecting unit 310, a first encoding unit 322, an audio signal encoder 330, a speech signal encoder 340 and a multiplexer 350. In this case, the sibilant detecting unit 310 and the first encoding unit 320 can have the same functions of the former elements 110 and 122 having the same names described with reference to FIG. 1.

The plural-channel encoder 305 generates a mono or stereo downmix signal by receiving an input of a plurality of channel signals (at least two channel signals) (hereinafter named a multi-channel signal) and then performing downmixing thereon. And, the plural-channel encoder 305 generates spatial information necessary to upmix a downmix signal into a multi-channel signal. In this case, the spatial information can include channel level difference information, inter-channel correlation information, channel prediction coefficient, downmix gain information and the like. If the audio signal encoding device 300 receives a mono signal, it is understood that the mono signal can bypass the plural-channel encoder 305 without being downmixed.

The sibilant detecting unit 310 detects a sibilant proportion of a current frame. If the detected sibilant proportion is non-sibilant, the sibilant detecting unit 310 delivers an audio signal to the first encoding unit 322. If the detected sibilant proportion is sibilant, an audio signal bypasses the first encoding unit 322 and the sibilant detecting unit 310 delivers the audio signal to the speech signal encoder 340. The sibilant detecting unit 310 generates coding scheme information indicating whether a band extension coding scheme is applied to the current frame and then delivers the generated coding scheme information to the multiplexer 350.

The first encoding unit 322 generates spectral data of narrow band and band extension information by applying the frequency domain based band extension scheme, which was described with reference to FIG. 1, to an audio signal of a wide band.

If a specific frame or segment of a downmix signal has a large audio characteristic, the audio signal encoder 330 encodes the downmix signal according to an audio coding scheme. In this case, the audio coding scheme may follow the AAC (advanced audio coding) standard or the HE-AAC (high efficiency advanced audio coding) standard, by which the present invention is non-limited. Meanwhile, the audio signal encoder 340 may correspond to an MDCT (modified discrete transform) encoder.

If a specific frame or segment of a downmix signal has a large speech characteristic, the speech signal encoder 340 encodes the downmix signal according to a speech coding scheme. In this case, the speech coding scheme may follow the AMR-WB (adaptive multi-rate wide-band) standard, by which the present invention is non-limited. Meanwhile, the speech signal encoder 340 can further include the former LPC (linear prediction coding) encoding part 124*a*-1, 124*b*-1 or 124*c*-1 described with reference to FIG. 5. If a harmonic signal has high redundancy on a time axis, it can be modeled by linear prediction for predicting a present signal from a past signal. In this case, if a linear prediction coding scheme is adopted, it is able to raise coding efficiency. Meanwhile, the speech signal encoder 340 can correspond to a time domain encoder.

And, the multiplexer 350 generates an audio signal bitstream by multiplexing spatial information, coding scheme information, band extension information, spectral data and the like.

As mentioned in the foregoing description, FIG. 10 shows the example of an encoding device to which the second/third embodiment 124*b*/124*c* of the second encoding unit described with reference to (B)/(C) of FIG. 5 is applied. This example is almost the same of the first example described with reference to FIG. 9. This example differs from the first example in that an audio signal corresponding to a whole band is encoded by an HBE encoding part 424 (or a PSDD encoding part) according to an HBE scheme or a PSDD scheme prior to being encoded by a speech signal encoder 440. As mentioned in the foregoing description with reference to FIG. 5, the HBE encoding part 424 generates HBE information by encoding an audio signal according to the time domain based band extension scheme. The HBE encoding part 424 can be replaced by the PSDD encoding part 424. As mentioned in the foregoing description with reference to FIGS. 6 to 8, the PSDD encoding part 424 encodes a target band using information of the copy band and then generates PSDD information for reconstructing the target band. The speech signal encoder 440 encodes the result, which was encoded according to the HBE or PSDD scheme, according to a speech signal scheme. Of course, the speech signal encoder 440 can further include an LPC encoding part like the first example.

Figure 11:
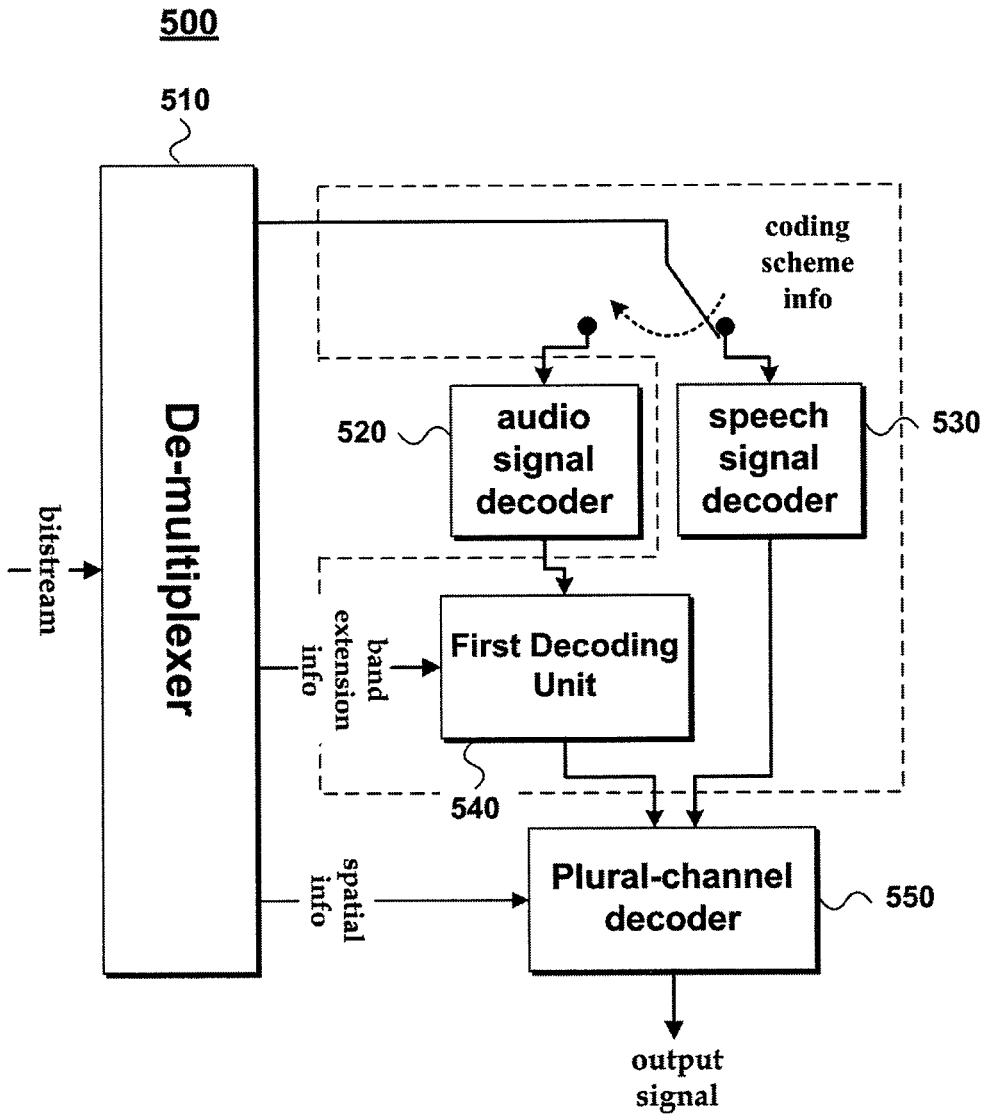
FIG. 11 is a block diagram for a first example of an audio signal decoding device to which an audio signal processing apparatus according to an embodiment of the present invention is applied.
Figure 12:
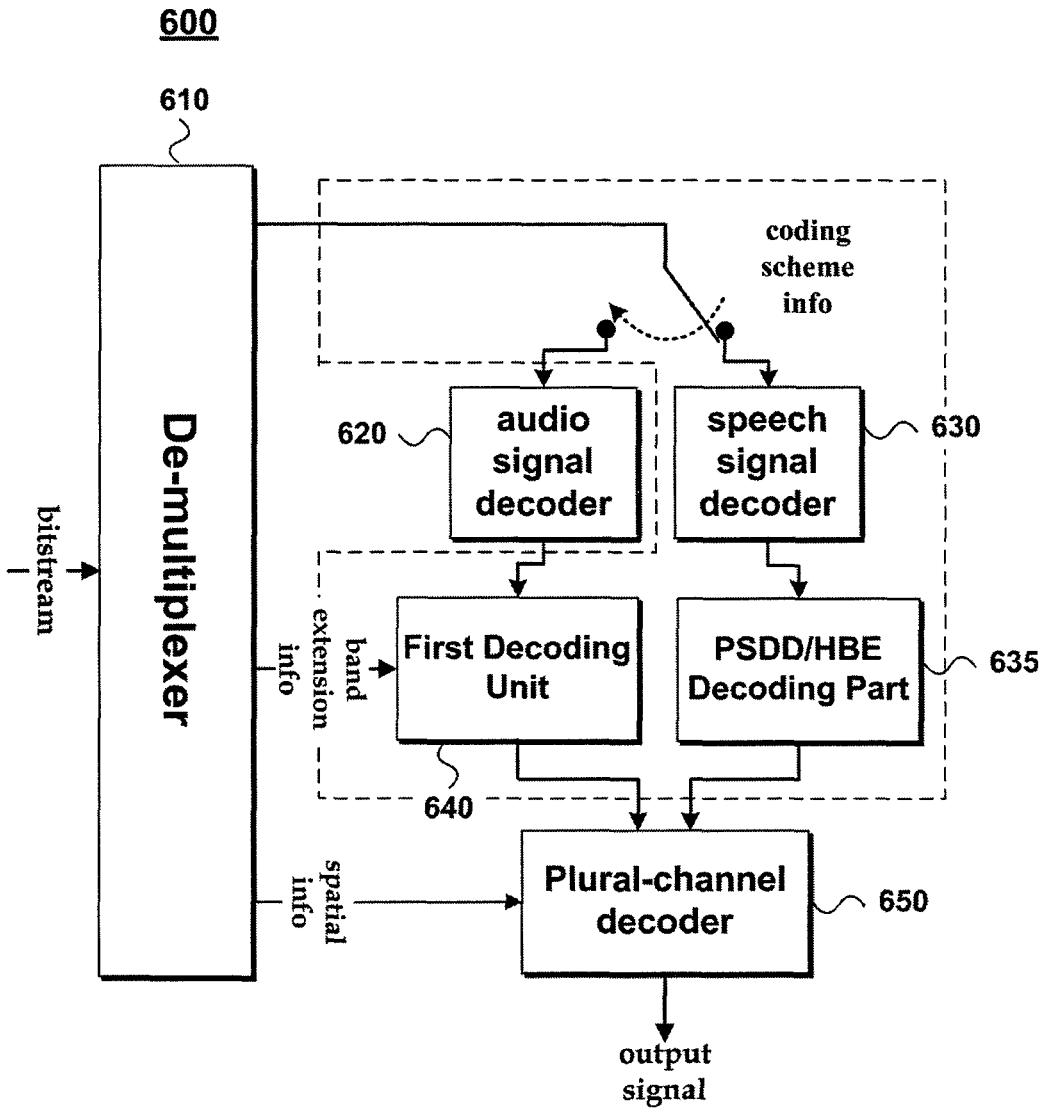
FIG. 12 is a block diagram for a second example of an audio signal decoding device to which an audio signal processing apparatus according to an embodiment of the present invention is applied.

FIG. 11 shows a first example of an audio signal decoding device to which an audio signal processing apparatus according to an embodiment of the present invention is applied, and FIG. 12 shows a second example of the audio signal decoding device. The first example is a decoding device to which the first embodiment 224*a* of the second decoding unit described with reference to (A) of FIG. 5 is applied. The second example is a decoding device to which the second/third embodiment 224*b*/224*c* of the second decoding unit described with reference to (B)/(C) of FIG. 5 is applied.

Referring to FIG. 11, an audio signal decoding device 500 includes a demultiplexer 510, an audio signal decoder 520, a speech signal decoder 530, a first decoding unit 540 and a plural-channel decoder 550.

The demultiplexer 510 extracts spectral data, coding scheme information, band extension information, spatial information and the like from an audio signal bitstream. The demultiplexer 510 delivers an audio signal corresponding to a current frame to the audio signal decoder 520 or the speech signal decoder 530 according to the coding scheme information. In particular, in case that the coding scheme information indicates that a band extension scheme is applied to the current frame, the demultiplexer 510 delivers the audio signal to the audio signal decoder 520. In case that the coding scheme information indicates that a band extension scheme is not applied to the current frame, the demultiplexer 510 delivers the audio signal to the speech signal decoder 530.

If spectral data corresponding to a downmix signal has a large audio characteristic, the audio signal decoder 520 decodes the spectral data according to an audio coding scheme. In this case, as mentioned in the foregoing description, the audio coding scheme can follow the AAC standard or the HE-AAC standard. Meanwhile, the audio signal decoder 520 can include a dequantizing unit (not shown in the drawing) and an inverse transform unit (not shown in the drawing). Therefore, the audio signal decoder 520 is able to perform dequantization and inverse transform on spectral data and scale factor carried on a bitstream.

If the spectral data has a large speech characteristic, the speech signal decoder 530 decodes a downmix signal according to a speech coding scheme. As mentioned in the forgoing description, the speech coding scheme may follow the AMR-WB (adaptive multi-rate wide-band) standard, by which the present invention is non-limited. As mentioned in the foregoing description with reference to FIG. 5, the speech signal decoder 530 can include the LPC decoding part 224*a*-1, 224*b*-1 or 224*c*-1.

The first decoding unit 540 decodes a band extension information bitstream and then generates an audio signal of a high frequency band by applying the aforesaid frequency domain based band extension scheme to an audio signal using the decoded information.

If the decoded audio signal is a downmix, the plural-channel decoder 550 generates an output channel signal of a multi-channel signal (stereo signal included) using spatial information.

As mentioned in the foregoing description, FIG. 12 shows the example of a decoding device to which the second/third embodiment 224*b*/224*c* of the second decoding unit described with reference to (B)/(C) of FIG. 5 is applied. This example is almost the same of the first example described with reference to FIG. 11. This example differs from the first example in that an audio signal corresponding to a whole band is decoded by an HBE decoding part 635 (or a PSDD decoding part) according to an HBE scheme or a PSDD scheme after having been decoded by a speech signal decoder 630. As mentioned in the foregoing description, the HBE decoding part 635 generates a high frequency signal by shaping an excitation signal of a low frequency using the HBE information. Meanwhile, the PSDD decoding part 635 reconstructs a target band using information of a copy band and PSDD information. The speech signal decoder 635 decodes the result, which was decoded according to the HBE or PSDD scheme, according to a speech signal scheme. Of course, the speech signal decoder 635 can further include an LPC decoding part 224*a*-1, 224*b*-1 or 224*c*-1 like the first example.

The audio signal processing apparatus according to the present invention is available for various products to use. Theses products can be grouped into a stand alone group and a portable group. A TV, a monitor, a settop box and the like can be included in the stand alone group. And, a PMP, a mobile phone, a navigation system and the like can be included in the portable group.

Figure 13:
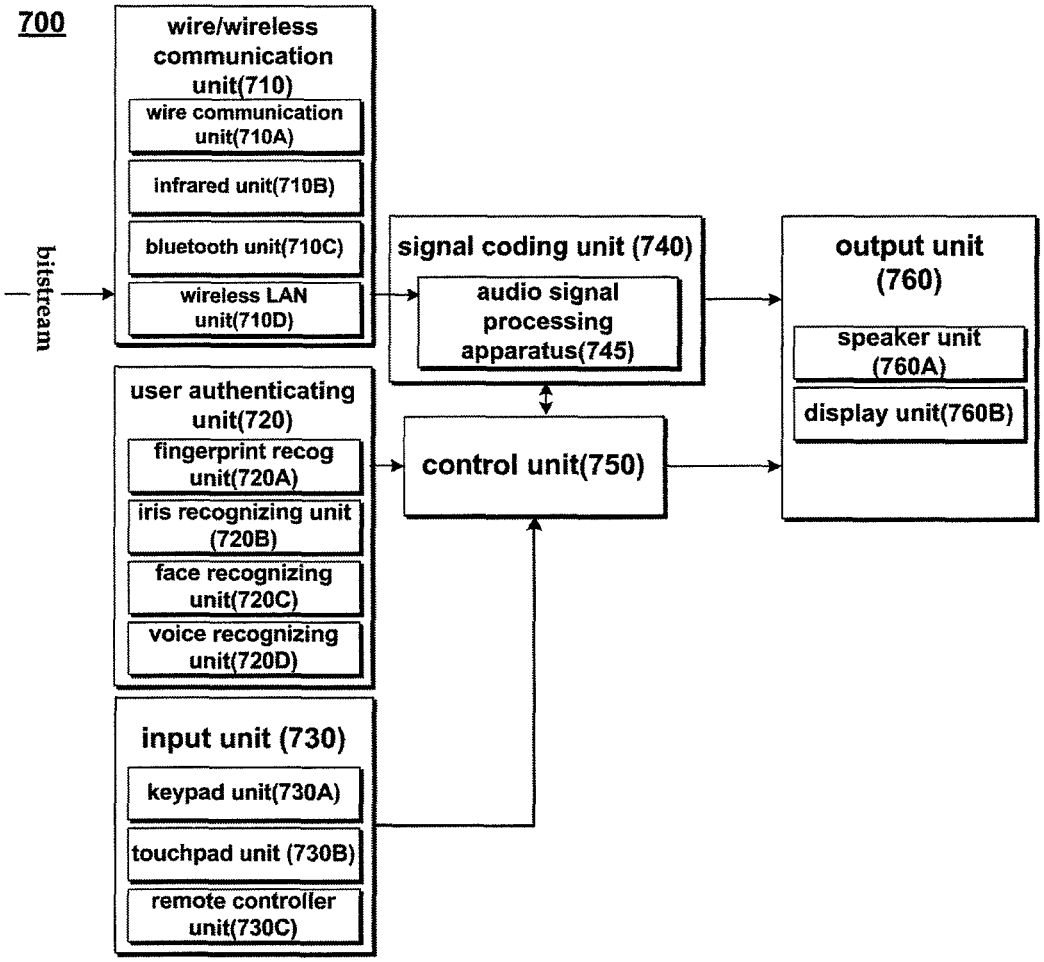
FIG. 13 is a schematic diagram of a product in which an audio signal processing apparatus according to an embodiment of the present invention is implemented.

FIG. 13 is a schematic diagram of a product in which an audio signal processing apparatus according to an embodiment of the present invention is implemented.

Referring to FIG. 13, a wire/wireless communication unit 710 receives a bitstream via wire/wireless communication system. In particular, the wire/wireless communication unit 710 can include at least one of a wire communication unit 710A, an infrared unit 710B, a Bluetooth unit 710C and a wireless LAN unit 710D.

A user authenticating unit 720 receives an input of user information and then performs user authentication. The user authenticating unit 720 can include at least one of a fingerprint recognizing unit 720A, an iris recognizing unit 720B, a face recognizing unit 720C and a voice recognizing unit 720D. The fingerprint recognizing unit 720A, the iris recognizing unit 720B, the face recognizing unit 720C and the speech recognizing unit 720D receive fingerprint information, iris information, face contour information and voice information and then convert them into user informations, respectively. Whether each of the user informations matches pre-registered user data is determined to perform the user authentication.

An input unit 730 is an input device enabling a user to input various kinds of commands and can include at least one of a keypad unit 730A, a touchpad unit 730B and a remote controller unit 730C, by which the present invention is non-limited.

A signal coding unit 740 performs encoding or decoding on an audio signal and/or a video signal, which is received via the wire/wireless communication unit 710, and then outputs an audio signal in time domain. The signal coding unit 740 includes an audio signal processing apparatus 745. As mentioned in the foregoing description, the audio signal processing apparatus 745 corresponds to the above-described embodiment of the present invention. Thus, the audio signal processing apparatus 745 and the signal coding unit including the same can be implemented by at least one or more processors.

A control unit 750 receives input signals from input devices and controls all processes of the signal decoding unit 740 and an output unit 760. In particular, the output unit 760 is an element configured to output an output signal generated by the signal decoding unit 740 and the like and can include a speaker unit 760A and a display unit 760B. If the output signal is an audio signal, it is outputted to a speaker. If the output signal is a video signal, it is outputted via a display.

Figure 14:
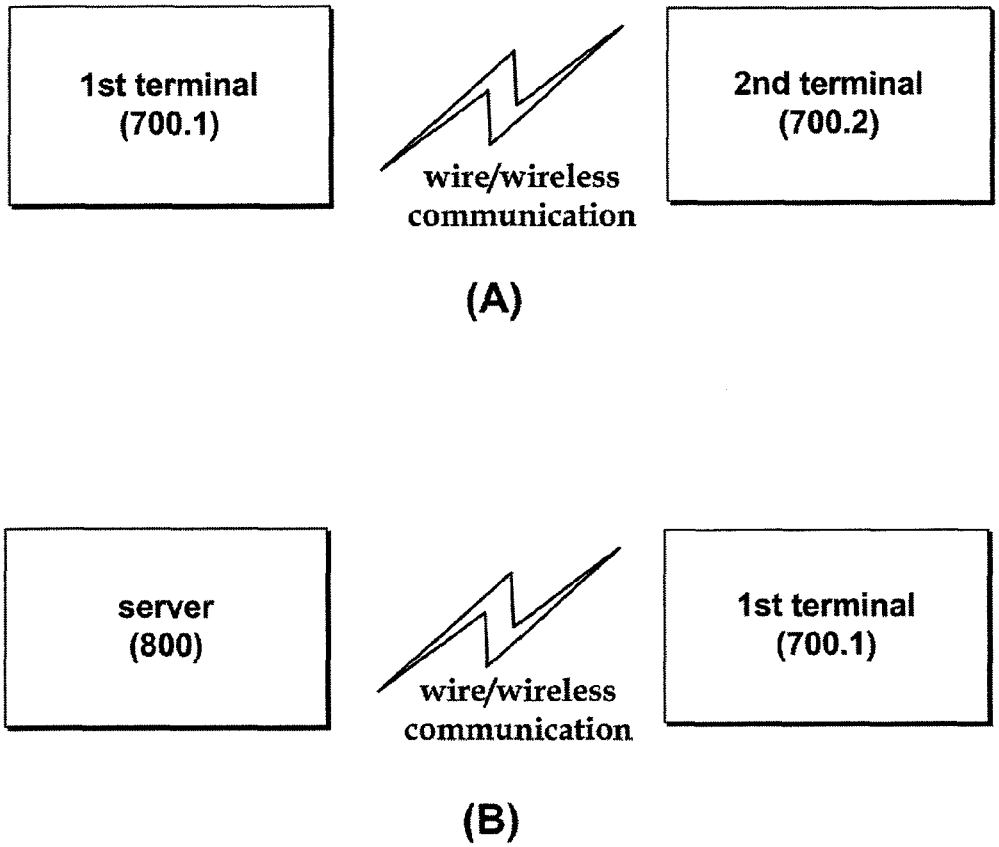
FIG. 14 is a diagram for relations of products provided with an audio signal processing apparatus according to an embodiment of the present invention.

FIG. 14 is a diagram for relations of products provided with an audio signal processing apparatus according to an embodiment of the present invention. FIG. 14 shows the relation between a terminal and server corresponding to the products shown in FIG. 13.

Referring to (A) of FIG. 14, it can be observed that a first terminal 700.1 and a second terminal 700.2 can exchange data or bitstreams bi-directionally with each other via the wire/wireless communication units.

Referring to FIG. (B) of FIG. 14, it can be observed that a server 800 and a first terminal 700.1 can perform wire/wireless communication with each other.

Figure 15:
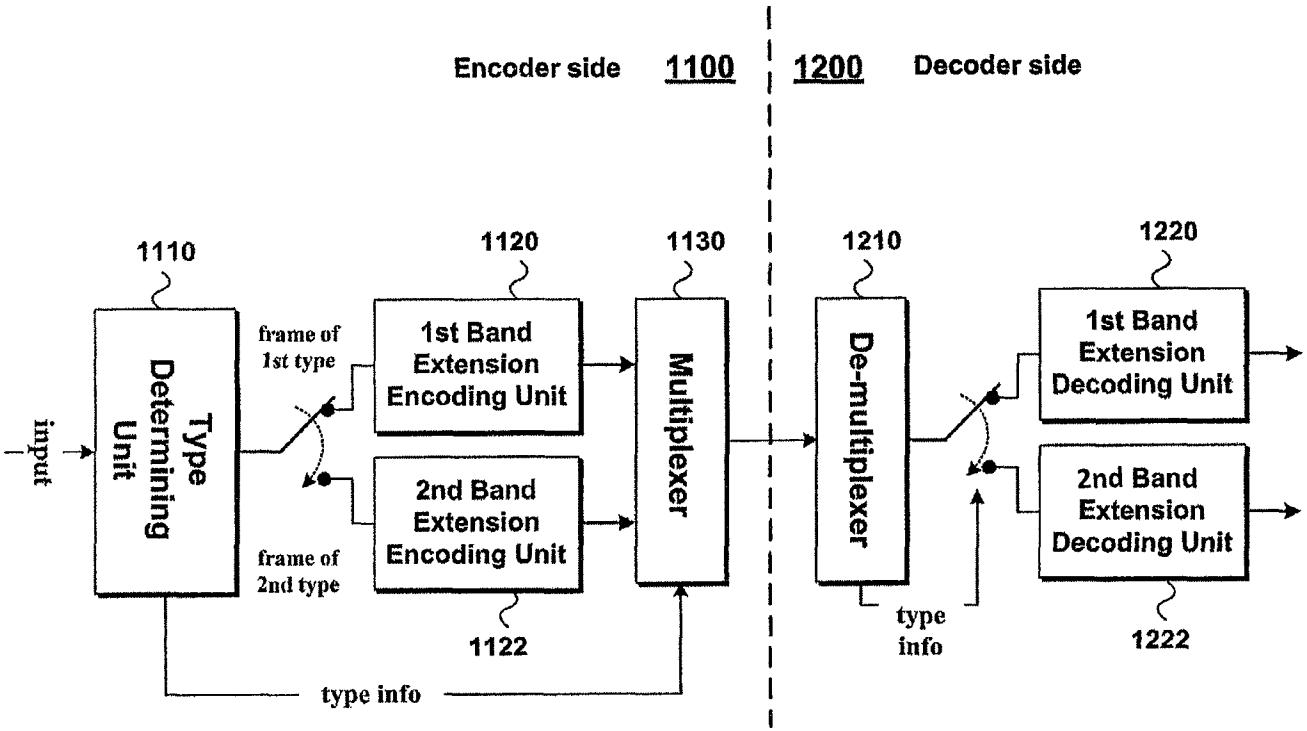
FIG. 15 is a block diagram of an audio signal processing apparatus according to another embodiment of the present invention.

FIG. 15 is a block diagram of an audio signal processing apparatus according to another embodiment of the present invention.

Referring to FIG. 15, an encoder side 1100 of an audio signal processing apparatus includes a type determining unit 1110, a first band extension encoding unit 1120, a second band extension encoding unit 1122 and a multiplexer 1130. And, a decoder side 1200 of the audio signal processing apparatus includes a demultiplexer 1210, a first band extension decoding unit 1220 and a second band extension decoding unit 1222.

The type determining unit 1110 analyzes an inputted audio signal and then detects a transient proportion. The type determining unit 1110 discriminates a stationary interval and a transient interval from each other. Based on this discrimination, the type determining unit 1110 determines a band extension scheme of a specific type for a current frame among at least two band extension schemes and then generates type information for identifying the determined scheme. Detailed configuration of the type determining unit 1110 will be explained later with reference to FIG. 16.

The first band extension encoding unit 1120 encodes a corresponding frame according to the band extension scheme of a first type. And, the second band extension encoding unit 1122 encodes a corresponding frame according to the band extension scheme of a second type. The first band extension encoding unit 1120 is able to perform bandpass filtering, time stretching processing, decimation processing and the like. The first type band extension scheme and the second type band extension scheme will be explained in detail with reference to FIG. 16, etc. later.

The multiplexer 1130 generates an audio signal bitstream by multiplexing the lower band spectral data generated by the first and second band extension encoding units 1120 and 1122 and the type information generated by the type determining unit 1110 and the like. The demultiplexer 1210 of the decoder side 1200 extracts the lower band spectral data, the type information and the like from the audio signal bitstream. Subsequently, the demultiplexer 1210 delivers a current frame to the first or second band extension decoding unit 1220 or 1222 according to the band extension scheme type indicated by the type information. The first band extension decoding unit 1220 reversely decodes the current frame according to the first type band extension scheme encoded by the first band extension encoding unit 1120. Moreover, the first band extension decoding unit 1220 is able to perform bandpass filtering, time stretching processing, decimation processing and the like. Likewise, the second band extension decoding unit 1222 generates spectral data of higher band using the lower band spectral data in a manner of decoding the current frame according to the second type band extension scheme.

Figure 16:
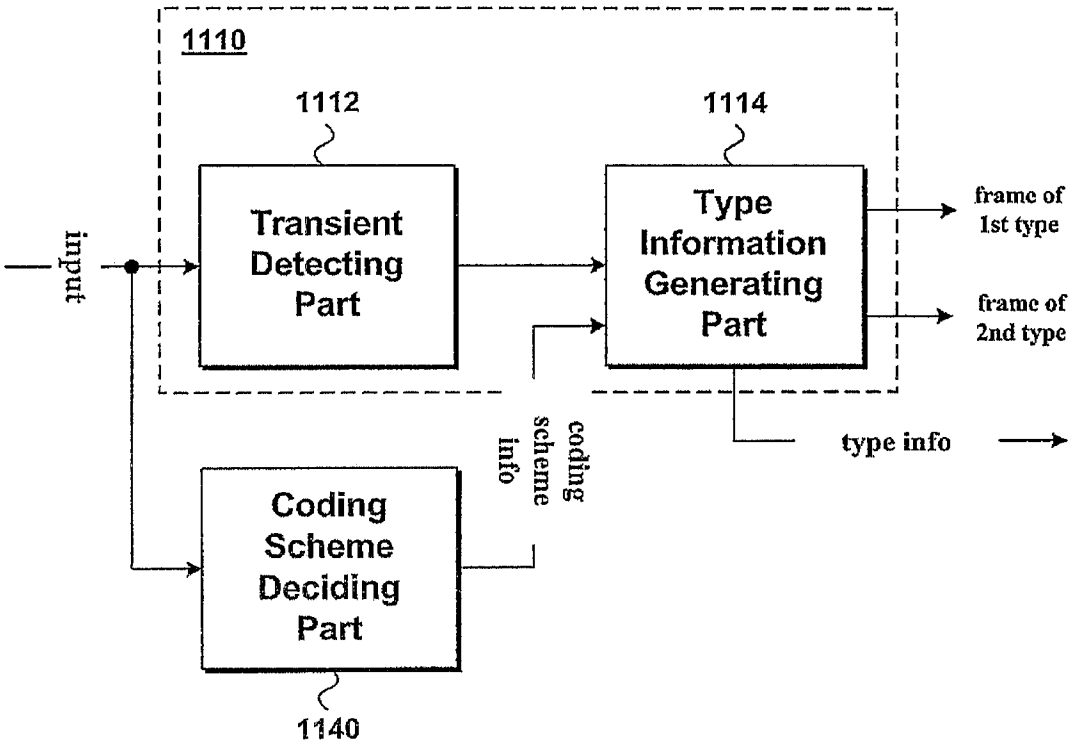
FIG. 16 is a detailed block diagram of a type determining unit 1110 shown in FIG. 15.

FIG. 16 is a detailed block diagram of the type determining unit 1110 shown in FIG. 15.

Referring to FIG. 16, the type determining unit 1110 includes a transient detecting part 1112 and a type information generating part 1114 and is linked with a coding scheme deciding part 1140.

The transient detecting part 1112 discriminates a stationary interval and a transient interval from each other by analyzing energy of an inputted audio signal. The stationary interval is an interval having a flat energy interval of an audio signal, whereas the transient interval is an interval in which energy of an audio signal varies abruptly. Since energy abruptly varies in the transient interval, a listener may have difficult in recognizing an artifact occurring according to a type change of a band extension scheme. On the contrary, since sound flows smoothly in the stationary interval, if a band extension scheme type is changed in this interval, it seems that the sound is interrupted abruptly and instantly. Hence, when it is necessary to change a time of a band extension scheme from a first type into a second type, if the type is changed not in the stationary interval but in the transient interval, it is able to hide the artifact according to the type change like the masking effect according to psychoacoustic model.

Thus, the type information generating part 1114 determines the band extension scheme of a specific type for a current frame among at least two band extension schemes and then generate type information indicating the determined band extension scheme. At least two band extension schemes will be described with reference to FIG. 18 later.

In order to determine a specific band extension scheme, a type of a band extension scheme is temporarily determined by referring to a coding scheme received from the coding scheme deciding part 1140 and then finally determines a type of the band extension scheme by referring to the information received from the transient detecting part 1112. This is explained in detail with reference to FIG. 17 as follows.

Figure 17:
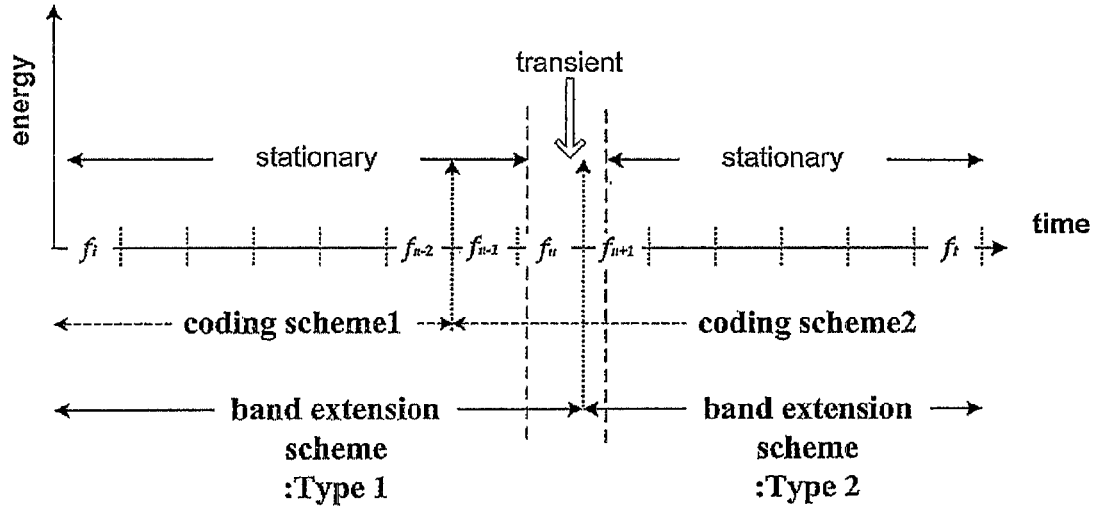
FIG. 17 is a diagram for explaining a process for determining a type of a band extension scheme.

FIG. 17 is a diagram for explaining a process for determining a type of a band extension scheme.

Referring to FIG. 17, first of all, a plurality of frames $f_n$ and $f_t$ exist on a time axis. A frequency domain based audio coding scheme (coding scheme 1) and a time domain based speech coding scheme (coding scheme 2) can be determined for each frame. In particular, according to this coding scheme, a type of a band extension scheme suitable for the corresponding coding scheme can be temporarily determined. For instance, a band extension scheme of a first type can be temporarily determined for the frames $f_i$ to $f_{n-2}$ corresponding to the audio coding scheme (coding scheme 1). And, a band extension scheme of a second type can be temporarily determined for the frames $f_{n-1}$ to $f_t$ corresponding to the speech coding scheme (coding scheme 2). Subsequently, by correcting the temporarily determined type by referring to whether an audio signal is in a stationary interval or a transient interval, a type of a band extension scheme is finally determined. For instance, referring to FIG. 17, if a temporarily determined type of a band extension scheme is made to be changed on a boundary between the frame $f_{n-2}$ and the frame $f_{n-1}$, since the frame $f_{n-2}$ and the frame $f_{n-1}$ exist in the stationary interval, the artifact according to a change of the band extension type is not hidden. Hence, the temporarily determined type of the band extension scheme is corrected to enable the change of the band extension scheme takes place in the transient interval ($f_n$, $f_{n+1}$). In particular, since the frames $f_{n-1}$ and $f_n$ exist in the stationary interval, the type of the band extension scheme is maintained as the first type. The band extension scheme of the second type is then applied from the frame $f_{n+1}$. In brief, the temporarily determined type is maintained during the frames except the frame n−1 and the frame n and the type is modified for the corresponding frame only in the final step.

Figure 18:
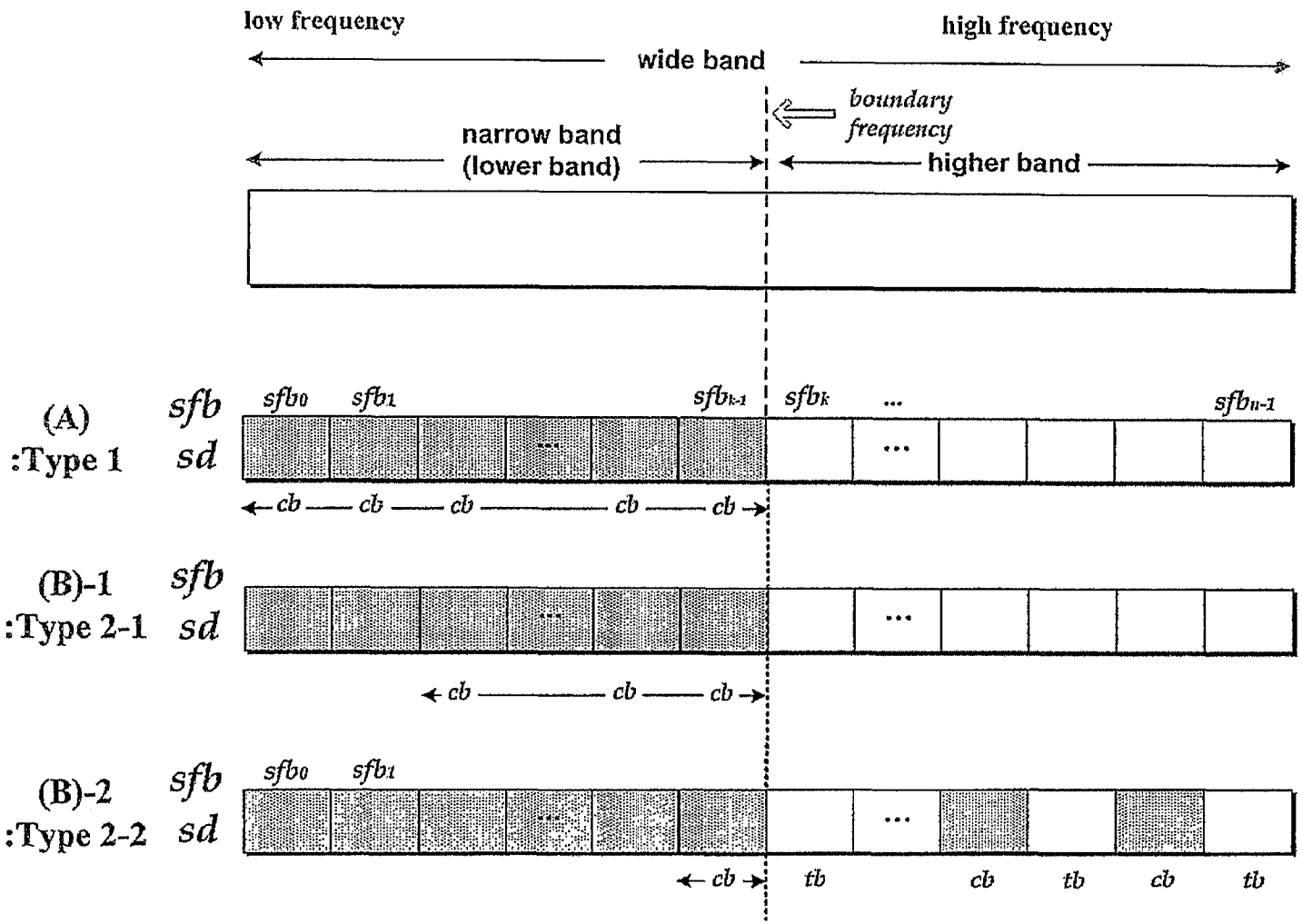
FIG. 18 is a diagram for explaining band extension schemes of various types.

FIG. 18 is a diagram for explaining band extension schemes of various types.

The following first band extension scheme may correspond to first band extension scheme mentioned with reference to FIG. 15, and the following second band extension scheme ay correspond to second band extension scheme mentioned with reference to FIG. 15. On the contrary, the following first band extension scheme may correspond to the second band extension scheme mentioned with reference to FIG. 15, and the following second band extension scheme may correspond to first band extension scheme mentioned with reference to FIG. 15.

As mentioned in the foregoing description, a band extension scheme generates wideband spectral data using narrowband spectral data. In this case, the narrowband may correspond to a lower band, whereas a newly generated band may correspond to a higher band.

Referring to (A) of FIG. 18, one example for a band extension scheme of a first type is shown. A first band extension coding scheme reconstructs a higher band by copying a first data area of a narrowband (or a lower band) [copy band]. In this case, the first data area may correspond to either all of narrowband or a plurality of portions of narrowband. And the portion may correspond to the following second data area, the first data area may be greater than the following second data area.

Referring to (B)-1 and (B)-2 of FIG. 18, a first example (type 2-1) and a second example (type 2-2) of a second band extension scheme are shown. A second type band extension scheme uses a second data area of a lower band for reconstruction of a higher band. The second data area may correspond to a portion of the received narrow band, and may be smaller than the foregoing first data area. Yet, in case of the first example for the second type, copy bands (cb) used in generating a higher band exist consecutively. In case of the second example for the second type, copy band exist not consecutively but is discretely distributed.

Figure 19:
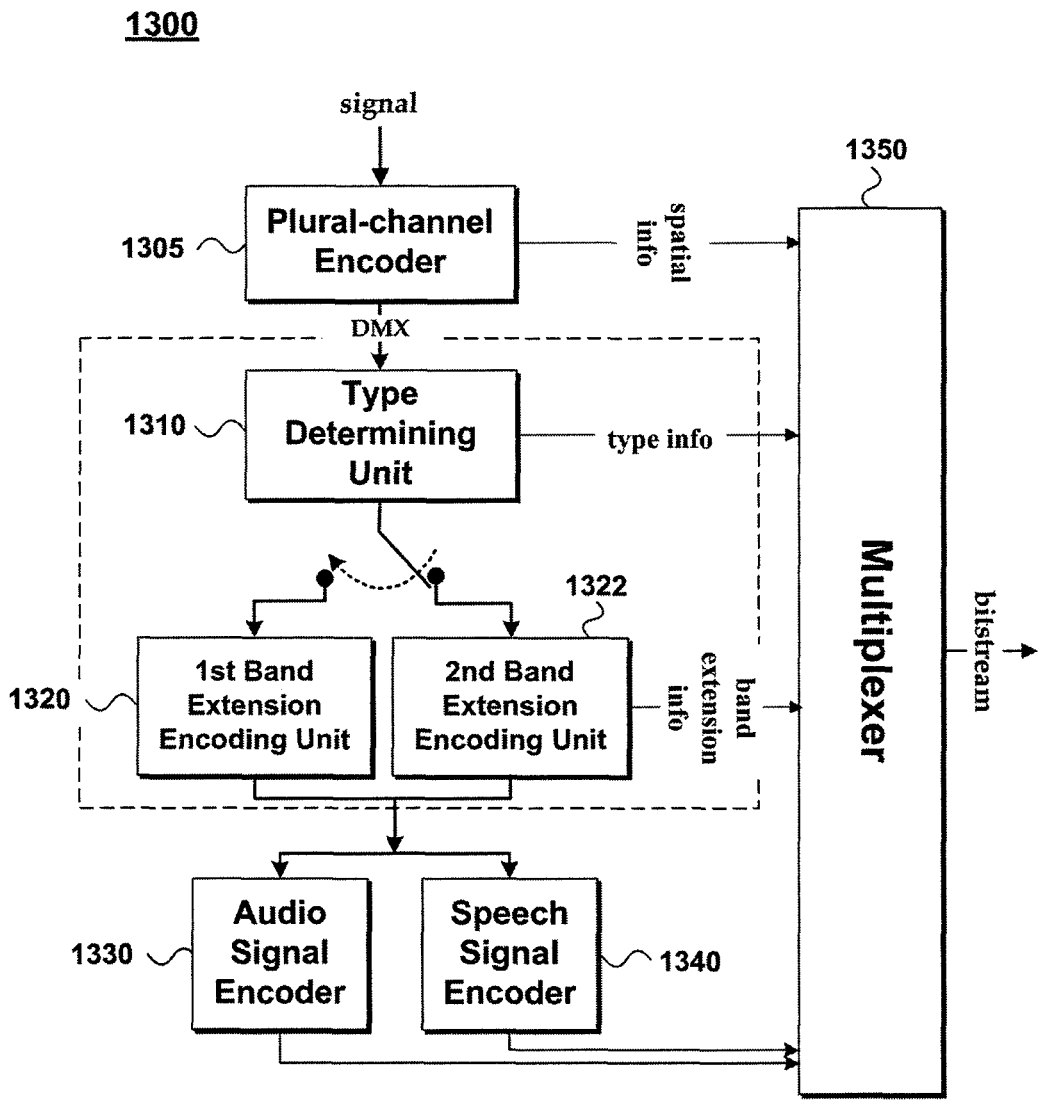
FIG. 19 is a block diagram of an audio signal encoding device to which an audio signal processing apparatus according to another embodiment of the present invention is applied.

FIG. 19 is a block diagram of an audio signal encoding device to which an audio signal processing apparatus according to another embodiment of the present invention is applied.

Referring to FIG. 19, an audio signal encoding apparatus 1300 includes a plural channel encoder 1305, a type determining unit 1310, a first band extension encoding unit 1320, a second band extension decoding unit 1322, an audios signal encoder 1330, a speech signal encoder 1340 and a multiplexer 1350. In this case, the type determining unit 1310, the first band extension encoding unit 1320 and second band extension decoding unit 1322 can have the same functions of the former elements 1110, 1120 and 1122 of the same names described with reference to FIG. 15, respectively.

The plural channel encoder 1305 receives an input of a plural channel signal (signal having at least two channels). The plural channel encoder 1305 generates a mono or stereo downmix signal by downmixing the received signal and also generates spatial information required for upmixing the downmix signal into a multi-channel signal. In this case, the spatial information can include channel level difference information, inter-channel correlation information, channel prediction coefficient, downmix gain information and the like. If the audio signal encoding apparatus 1300 receives a mono signal, it is understood that the received mono signal can bypass the plural channel encoder 1305 instead of being downmixed by the plural channel encoder 1305.

The type determining unit 1310 determines a type of a band extension scheme to apply to a current frame and then generates type information indicating the determined type. If a first band extension scheme is applied to a current frame, the type determining unit 1310 delivers an audio signal to the first band extension encoding unit 1320. If a second band extension scheme is applied to a current frame, the type determining unit 1310 delivers an audio signal to the second band extension encoding unit 1322. Each of the first and second band extension encoding units 1320 and 1322 generates band extension information for reconstructing a higher band using a lower band by applying a band extension scheme according to each type. Subsequently, a signal encoded by a band extension scheme is encoded by the audio signal encoder 1330 or the speech signal encoder 134 according to a characteristic of the signal irrespective of a type of the band extension scheme. Coding scheme information according to the characteristic of the signal may include the information generated by the former coding scheme deciding part 1340 described with reference to FIG. 18. This information can be delivered to the multiplexer 1350 like other information.

If a specific frame or segment of a downmix signal has a dominant audio characteristic, the audio signal encoder 1330 encodes the downmix signal according to a audio coding scheme. In this case, the audio coding scheme may follow the AAC (advanced audio coding) standard or the HE-AAC (high efficiency advanced audio coding) standard, by which the present invention is non-limited. Meanwhile, the audio signal encoder 1330 may include a MDCT (modified discrete transform) encoder.

If a specific frame or segment of a downmix signal has a dominant speech characteristic, the speech signal encoder 1340 encodes the downmix signal according to a speech coding scheme. In this case, the speech coding scheme may follow the AMR-WB (adaptive multi-rate wideband) standard, by which the present invention is non-limited. Meanwhile, the speech signal encoder 1340 can further include a LPC (linear prediction coding) encoding part. If a harmonic signal has high redundancy on a time axis, it can be modeled by linear prediction for predicting a current signal from a past signal. In this case, if a linear prediction coding scheme is adopted, it is able to raise coding efficiency. Meanwhile, the speech signal encoder 1340 can include a time domain encoder.

And, the multiplexer 1350 generates an audio signal bitstream by multiplexing spatial information, coding scheme information, band extension information, spectral data and the like.

Figure 20:
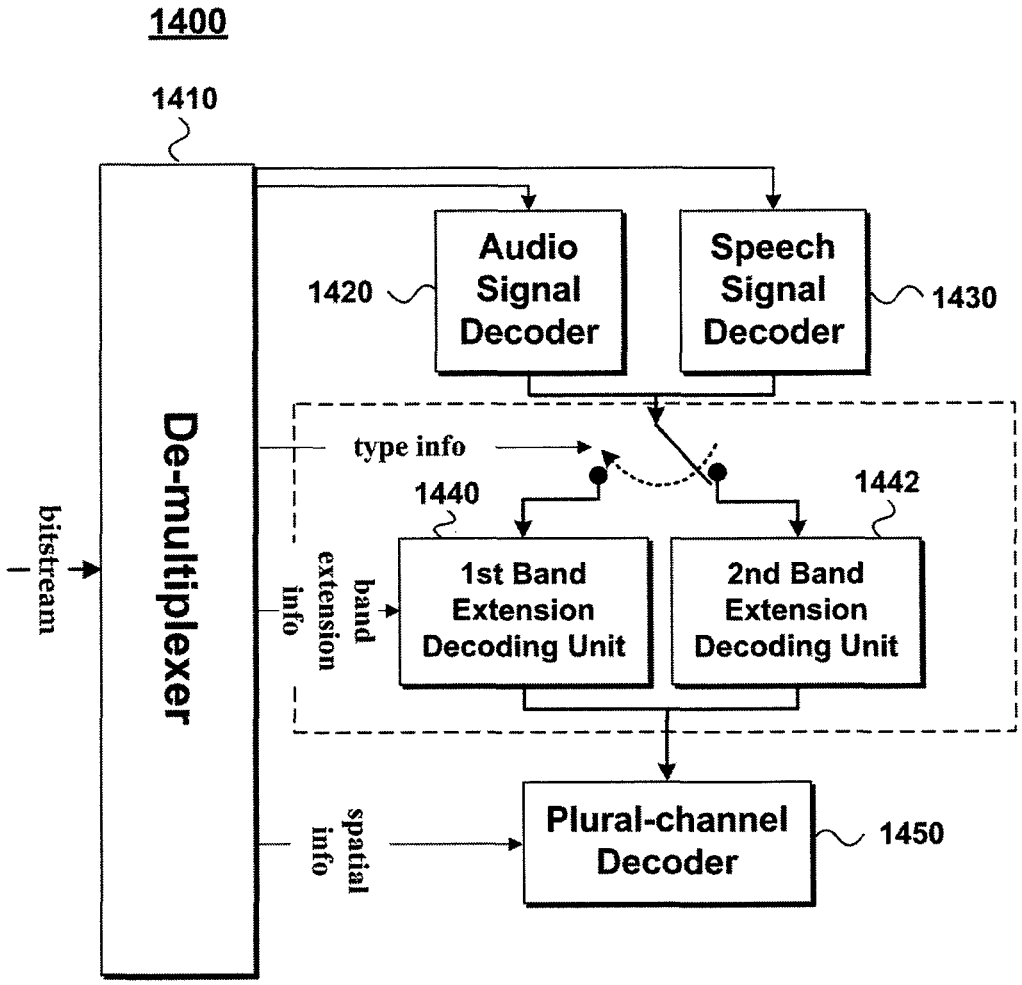
FIG. 20 is a block diagram of an audio signal decoding device to which an audio signal processing apparatus according to another embodiment of the present invention is applied.

FIG. 20 is a block diagram of an audio signal decoding device to which an audio signal processing apparatus according to another embodiment of the present invention is applied.

Referring to FIG. 20, an audio signal decoding apparatus 1400 includes a demultiplexer 1410, an audio signal decoder 1420, a speech signal decoder 1430, a first band extension decoding unit 1440, a second band extension decoding unit 1442 and a plural channel decoder 1450.

The demultiplexer 1410 extracts spatial information, coding scheme information, band extension information, spectral data and the like from an audio signal bitstream. According to the coding scheme information, the demultiplexer 1410 delivers an audio signal corresponding to a current frame to the audio signal decoder 1420 or the speech signal decoder 1430.

If the spectral data corresponding to a downmix signal has a dominant audio characteristic, the audio signal decoder 1420 decodes the spectral data according to an audio coding scheme. In this case, as mentioned in the foregoing description, the audio coding scheme can follow the AAC standard, the HE-AAC standard, etc. Meanwhile, the audio signal decoder 1420 can include a dequnatizing unit (not shown in the drawing) and an inverse transform unit (not shown in the drawing). Therefore, the audio signal decoder 1420 is able to perform dequantization and inverse-transform on the spectral data and scale factor carried on the bitstream.

If the spectral data has a dominant speech characteristic, the speech signal decoder 1430 decodes the downmix signal according to a speech coding scheme. As mentioned in the foregoing description, the speech coding scheme may follow the AMR-WB (adaptive multi-rate wideband) standard, by which the present invention is non-limited. And, the speech signal decoder 1430 can include an LPC decoding part.

As mentioned in the foregoing description, according to the type information indicating specific extension information among at least two band extension schemes, the audio signal is delivered to the first band extension decoding unit 1440 or the second band extension decoding unit 1442. The first/second band extension decoding unit 1440/1442 reconstructs wideband spectral data using a portion or whole part of the narrowband spectral data according to the band extension scheme of the corresponding type.

If the decoded audio signal is a downmix, the plural channel decoder 1450 generates an output channel signal of a multi-channel signal (stereo signal included) using the spatial information.

The audio signal processing apparatus according to the present invention is available for various products to use. Theses products can be grouped into a stand alone group and a portable group. A TV, a monitor, a settop box and the like belong to the stand alone group. And, a PMP, a mobile phone, a navigation system and the like belong to the portable group.

Figure 21:
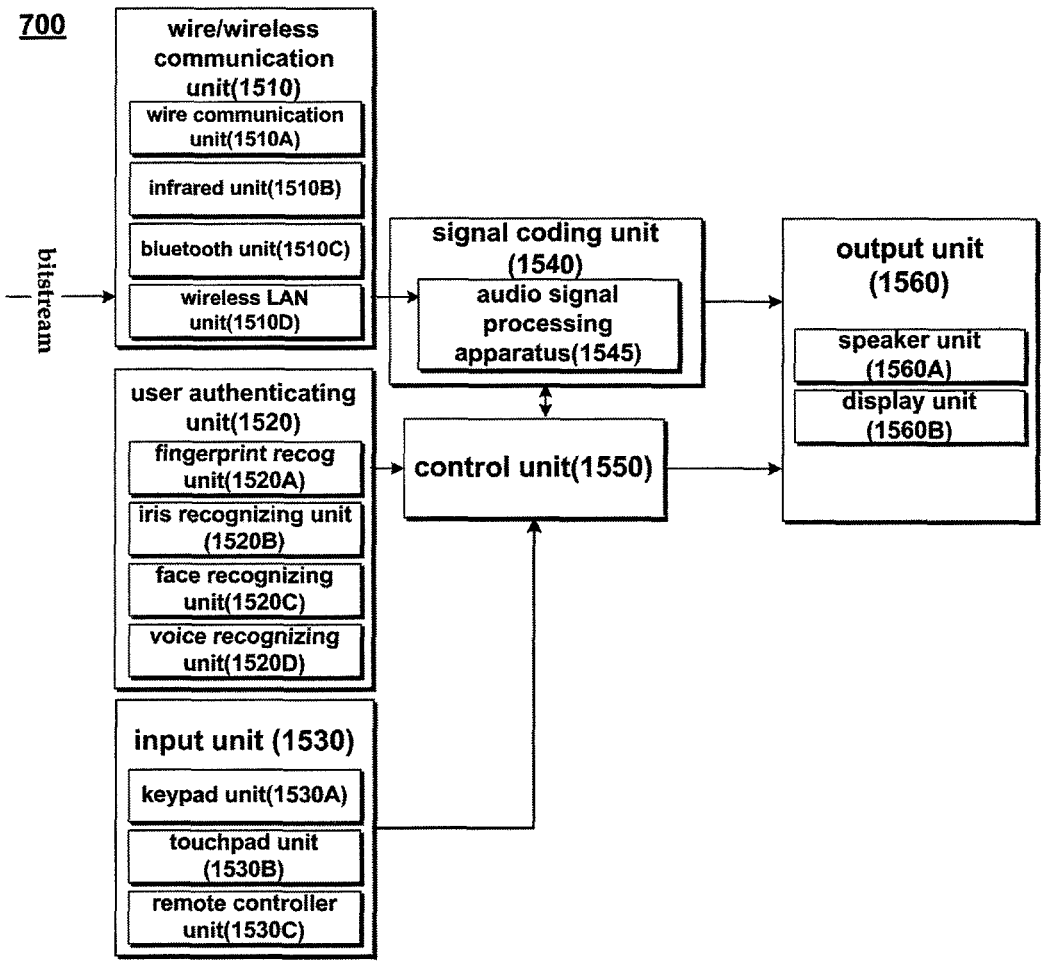
FIG. 21 is a schematic diagram of a product in which an audio signal processing apparatus according to an embodiment of the present invention is implemented.
Figure 22:
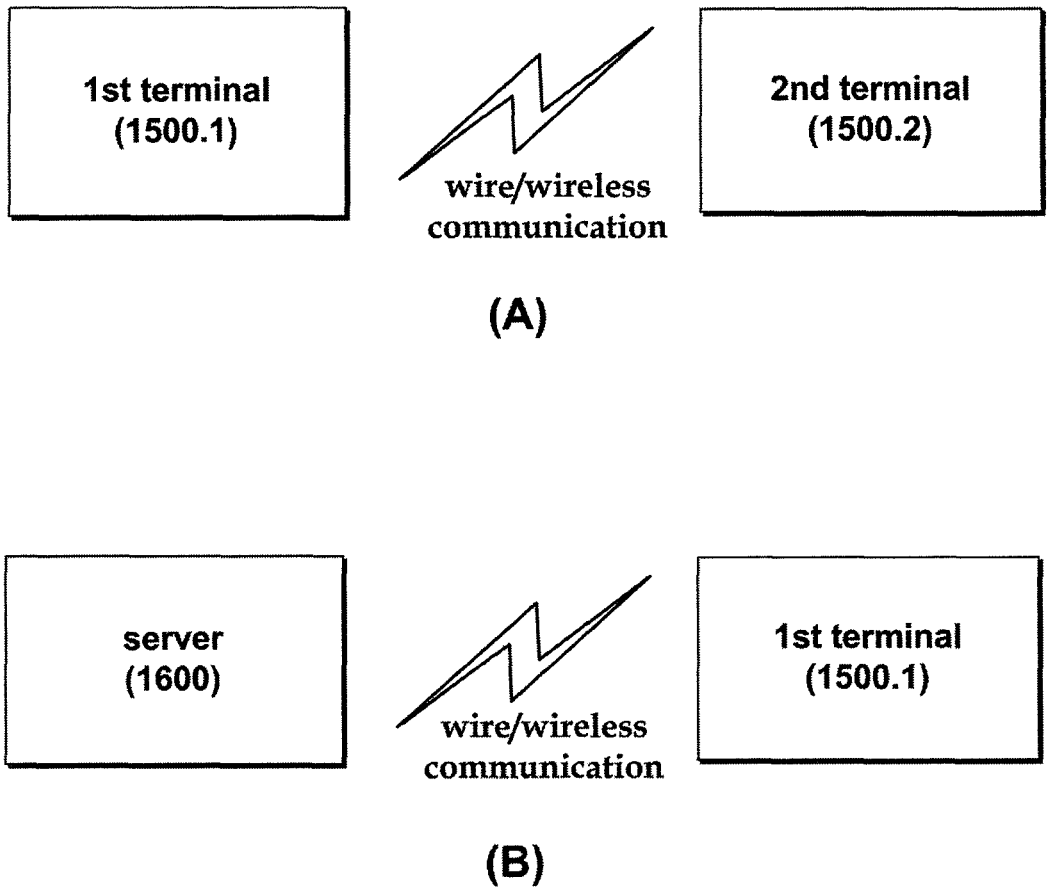
FIG. 22 is a diagram for relations between products provided with an audio signal processing apparatus according to an embodiment of the present invention.

FIG. 21 is a schematic diagram of a product in which an audio signal processing apparatus according to an embodiment of the present invention is implemented, and FIG. 22 is a diagram for relations between products provided with an audio signal processing apparatus according to an embodiment of the present invention.

Referring to FIG. 21, a wire/wireless communication unit 1510, a user authenticating unit 1520, an input unit 1530, a signal coding unit 1540, a control unit 1550 and an output unit 1560 are included. The elements except the signal coding unit 1540 perform the same function of the former element of the same names described with reference to FIG. 12. Meanwhile, the signal coding unit 1540 performs encoding or decoding on the audio and/or video signal received via the wire/wireless communication unit 1510 and then outputs a time-domain audio signal. The signal coding unit 1540 includes an audio signal processing apparatus 1545, which corresponds to that of the former embodiment of the present invention described with reference to FIGS. 15 to 20. The audio signal processing apparatus 1545 and the signal coding unit including the same can be implemented by at least one processor.

FIG. 22 is a diagram for relations between products provided with an audio signal processing apparatus according to one embodiment of the present invention. FIG. 22 shows the relation between a terminal and a server corresponding to the products shown in FIG. 21. Referring to (A) of FIG. 22, it can be observed that a first terminal 1500.1 and a second terminal 1500.2 can exchange data or bitstreams bi-directionally with each other via the wire/wireless communications units. Referring to FIG. (B) of FIG. 22, it can be observed that a server 1600 and a first terminal 1500.1 can perform wire/wireless communication with each other.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example. And, a bitstream generated by the above encoding method can be stored in the computer-readable recording medium or can be transmitted via wire/wireless communication network.

Accordingly, the present invention provides the following effects and/or advantages.

First of all, the present invention selectively applies a band extension scheme per frame according to a characteristic of a signal per frame, thereby enhancing a quality of sound without incrementing the number of bits considerably.

Secondly, the present invention applies an LPC (linear predictive coding) scheme suitable for a speech signal, an HBE (high band extension) scheme or a scheme (PSDD) newly proposed by the present invention to a frame determined as including a sound (e.g., sibilant) having high frequency band energy therein instead of a band extension scheme, thereby minimizing a loss of sound quality.

Thirdly, the present invention applies various types of band extension scheme per time, in the application of various types of band extension scheme, because it is able to reduce artifact of interval in change of band extension scheme, it is able to improve sound quality of audio signal with applying band extension scheme.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Accordingly, the present invention is applicable to encoding and decoding an audio signal.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method for processing an audio signal, the method comprising:

receiving, by an audio processing apparatus, a spectral data of a lower band, coding scheme information, and type information, the coding scheme information indicating an audio coding scheme or a speech coding scheme, the type information indicating a first band extension scheme or a second band extension scheme for a current frame of the audio signal;

decoding, by the audio processing apparatus, the spectral data of the lower band using one of the audio coding scheme and the speech coding scheme based on the coding scheme information;

when the type information indicates the first band extension scheme for the current frame, generating, by the audio processing apparatus, a spectral data of a higher band in the current frame using the decoded spectral data of the lower band by performing the first band extension scheme; and when the type information indicates the second band extension scheme for the current frame, generating, by the audio processing apparatus, the spectral data of the higher band in the current frame using the decoded spectral data of the lower band by performing the second band extension scheme, wherein the first band extension scheme is based on a first data area of the spectral data of the lower band, and the first data area corresponds to a portion of the spectral data of the lower band, said portion being less than all of the spectral data of the lower band, and wherein the second band extension scheme is based on a second data area of the spectral data of the lower band, and the second data area corresponds to all of the spectral data of the lower band.

2. The method of claim 1, wherein the second data area is greater than the first data area.

3. The method of claim 1, wherein the higher band comprises at least one band equal to or higher than a boundary frequency, and wherein the lower band comprises at least one band equal to or lower than the boundary frequency.

4. The method of claim 1, wherein the first band extension scheme is performed using at least one operation of bandpass filtering, time stretching processing and decimation processing.

5. The method of claim 1, further comprising receiving band extension information including envelop information, wherein the first band extension scheme or the second band extension scheme is performed using the band extension information.

6. The method of claim 1, further comprising:

receiving spatial information used to upmix the spectral data, the spatial information including channel level information; and upmixing the spectral data of the lower band and the higher band using the spatial information.

7. An apparatus for processing an audio signal, the apparatus comprising:

a de-multiplexer receiving a spectral data of a lower band, coding scheme information, and type information, the coding scheme information indicating an audio coding scheme or a speech coding scheme, the type information indicating a first band extension scheme or a second band extension scheme;

an audio and speech signal decoder decoding the spectral data of the lower band using one of the audio coding scheme and the speech coding scheme based on the coding scheme information;

a first band extension decoding unit, when the type information indicates the first band extension scheme for a current frame, generating a spectral data of a higher band in the current frame using the decoded spectral data of the lower band by performing the first band extension scheme; and a second band extension decoding unit, when the type information indicates the second band extension scheme for the current frame, generating the spectral data of the higher band in the current frame using the decoded spectral data of the lower band by performing the second band extension scheme, wherein the first band extension scheme is based on a first data area of the spectral data of the lower band, and the first data area corresponds to a portion of the spectral data of the lower band, said portion being less than all of the spectral data of the lower band, and wherein the second band extension scheme is based on a second data area of the spectral data of the lower band, and the second data area correspond to all of the spectral data of the lower band.

8. The apparatus of claim 7, wherein the second data area is greater than the first data area.

9. The apparatus of claim 7, wherein the higher band comprises at least one band equal to or higher than a boundary frequency, and wherein the lower band comprises at least one band equal to or lower than the boundary frequency.

10. The apparatus of claim 7, wherein the first band extension scheme is performed using at least one operation of bandpass filtering, time stretching processing and decimation processing.

11. The apparatus of claim 7, wherein the de-multiplexer further receives band extension information including envelop information, and wherein the first band extension scheme or the second band extension scheme is performed using the band extension information.

12. The apparatus of claim 7, wherein the audio and speech decoder includes:

an audio signal decoder decoding the spectral data of the lower band according to an audio coding scheme on frequency domain; and a speech signal decoder decoding the spectral data of the lower band according to a speech coding scheme on time domain, and wherein the spectral data of the higher band is generated using the spectral data of the lower band decoded by either the audio signal decoder or the speech signal decoder.

13. A non-transitory computer-readable medium comprising instructions stored thereon, which, when executed by a processor, causes the processor to perform operations, the instructions comprising:

receiving a spectral data of a lower band, coding scheme information, and type information, the coding scheme information indicating an audio coding scheme or a speech coding scheme, the type information indicating a first band extension scheme or a second band extension scheme for a current frame of an audio signal;

decoding the spectral data of the lower band using one of the audio coding scheme and the speech coding scheme based on the coding scheme information;

when the type information indicates the first band extension scheme for the current frame, generating a spectral data of a higher band in the current frame using the spectral data of the lower band by performing the first band extension scheme; and when the type information indicates the second band extension scheme for the current frame, generating the spectral data of the higher band in the current frame using the spectral data of the lower band by performing the second band extension scheme, wherein the first band extension scheme is based on a first data area of the spectral data of the lower band, and the first data area corresponds to a portion of the spectral data of the lower band, said portion being less than all of the spectral data of the lower band, and wherein the second band extension scheme is based on a second data area of the spectral data of the lower band, and the second data area corresponds to all of the spectral data of the lower band.

* * * * *